US012478161B2

(12) United States Patent
Wilson-Brooks et al.

(10) Patent No.: US 12,478,161 B2
(45) Date of Patent: Nov. 25, 2025

(54) METHOD AND DEVICE FOR REMOVAL OF NAIL-ENHANCEMENT PRODUCT

(71) Applicant: Hummingbird SM, LLC, Columbus, OH (US)

(72) Inventors: Susan K. Wilson-Brooks, Columbus, OH (US); Maurina L. Brooks, Columbus, OH (US)

(73) Assignee: Hummingbird SM, LLC, Columbus, OH (US)

( * ) Notice: Subject to any disclaimer, the term of this patent is extended or adjusted under 35 U.S.C. 154(b) by 1049 days.

(21) Appl. No.: 17/488,700

(22) Filed: Sep. 29, 2021

(65) Prior Publication Data

US 2022/0015521 A1 Jan. 20, 2022

Related U.S. Application Data

(63) Continuation-in-part of application No. 16/831,495, filed on Mar. 26, 2020, now abandoned.

(60) Provisional application No. 62/826,682, filed on Mar. 29, 2019.

(51) Int. Cl.
*A45D 29/00* (2006.01)

(52) U.S. Cl.
CPC ..... *A45D 29/007* (2013.01)

(58) Field of Classification Search
CPC ..... A45D 29/007; A45D 29/17; A45D 29/22; A45D 29/00; A45D 2029/008
See application file for complete search history.

(56) References Cited

U.S. PATENT DOCUMENTS 2,138,626 A * 11/1938 Irving ..... A61F 13/105 128/880
3,348,541 A * 10/1967 Loebeck ..... A61F 13/105 2/21
3,369,553 A * 2/1968 Keesee ..... A45D 29/007 15/210.1

(Continued)

OTHER PUBLICATIONS

Clarivate Analytics copyrighted translation of Fujinoki WO2016/147480A1; international filing date Nov. 15, 2015 (Year: 2015).*

(Continued)

*Primary Examiner* — Thomas C Barrett
*Assistant Examiner* — Sarah Woodhouse
(74) *Attorney, Agent, or Firm* — McDonnell Boehnen Hulbert & Berghoff LLP

(57) ABSTRACT

A device for removing nail-enhancement product from nail beds from a finger or toe having a semi-rigid body, an absorbent pad, and a flexible cover. The semi-rigid body having an adjustable proximal end, a distal end, an external portion, an internal portion, an aperture, and a retaining member. The absorbent pad is positioned in the internal portion of the semi-rigid body between the retaining member and the distal end of the semi-rigid body. The flexible cover is adapted to surround the semi-rigid body with the absorbent pad. The absorbent pad is placed on top of the nail bed. The absorbent pad is wetted with removing solution, such as acetone, to loosen nail-enhancement product from nail bed. Excess removing solution is collected in a reservoir tip. The nail-enhancement product and associated residues adhere to the absorbent pad and remain contained inside the device.

20 Claims, 23 Drawing Sheets

(56) References Cited

U.S. PATENT DOCUMENTS 3,967,631 A * 7/1976 Kosal ..... A41D 13/087 132/73
4,694,508 A * 9/1987 Iriyama ..... A41D 13/087 2/21
5,026,541 A * 6/1991 Lanier ..... A45D 29/007 132/73
5,093,933 A * 3/1992 Berry ..... A41D 19/01517 2/21
5,693,401 A * 12/1997 Sommers ..... A41D 19/0089 24/442
6,305,383 B1 * 10/2001 Thoma ..... A45D 31/00 132/73
6,367,485 B1 * 4/2002 Dutton-Davis ..... A45D 29/007 132/73
6,634,367 B2 * 10/2003 Abraham ..... A45D 29/004 132/285
6,988,502 B2 * 1/2006 Tsukamoto ..... A45D 31/00 132/73
7,640,937 B1 * 1/2010 Scott ..... A45D 29/007 132/74.5
D821,697 S * 7/2018 Matalon ..... D2/617
10,470,832 B1 * 11/2019 Jones ..... A61B 42/10
11,327,565 B1 * 5/2022 Ribordy ..... G06F 3/0412
2010/0083974 A1 * 4/2010 Milican ..... A45D 29/007 132/73
2011/0284017 A1 * 11/2011 Nakamura ..... A45D 31/00 132/73
2014/0007894 A1 * 1/2014 Gagnon ..... A45D 29/00 132/200
2014/0310905 A1 * 10/2014 Kurokawa ..... A45D 29/12 15/244.1
2015/0013709 A1 * 1/2015 Scheurn ..... A45D 29/18 132/73
2017/0049209 A1 * 2/2017 Blaisdell ..... A45D 29/007
2017/0119128 A1 * 5/2017 Wilson ..... A45D 29/007
2018/0055191 A1 * 3/2018 Nguyen ..... A41D 19/0055
2019/0254403 A1 * 8/2019 Biddle ..... A45D 34/041
2021/0093845 A1 * 4/2021 Biddle ..... A61K 8/365

OTHER PUBLICATIONS

Haodoyoun, https://haodoyoungo.blogspot.com/2013/06/review-cvs-pharmacy-nail-polish-remover.html, Jun. 13, 2013 (Year: 2013).*

* cited by examiner

METHOD AND DEVICE FOR REMOVAL OF NAIL-ENHANCEMENT PRODUCT

This non-provisional application is a continuation-in-part of and claims priority and the benefit of U.S. patent application Ser. No. 16/831,495, filed on Mar. 26, 2020, which claims priority to and the benefit of U.S. Provisional Application No. 62/826,682, filed on Mar. 29, 2019, both herein incorporated by reference.

Nail-enhancement products, such as artificial nails, have been around for hundreds of years. In the past, materials such as bone, ivory and gold were used to create artificial nails. Nowadays, most nail-enhancement products involve the use of acrylic. Acrylics are a special family of monomers and/or oligomers and/or polymers used to create nail-enhancement products, including UV gel nails and acrylic (liquid-and-powder) nails. Other nail-enhancement products include gel nail polish. However, removing acrylic and/or gel nails is challenging and may cause severe damage to natural nail beds. Similarly, removing gel nail polish may cause wear and tear on the nail beds weakening the same and damaging cuticles.

Conventional methods for removing acrylic or gel coatings from fingernails or toenails can be cumbersome and hazardous. Presently, a method for removing acrylic or gel coatings includes saturating a cotton ball with a removing solution, such as acetone, placing the cotton ball on top of the nail bed, and wrapping the soaked, dripping cotton ball with an aluminum foil sheet. The foil sheet is then squeezed around the finger or toe and the saturated cotton ball is rubbed against the nail bed to remove the acrylic or gel coating. This method presents many challenges. The aluminum foil sheet is not leak-proof. Thus, the removing solution may drip all over the finger or toe and even on the floor or user. Additionally, hazardous fumes may escape the aluminum foil exposing the user and those around them to the same.

Another conventional method for removing acrylic or gel coatings on nails involves immersing the coated nails in a receptacle containing removing solution, such as acetone, and leaving the nails submerged until the acrylic or gel coating has softened, which usually takes about 15-20 minutes. Some methods include the further step of heating up the acetone and then submerging the coated nails in the removing solution until the acrylic or gel coating has softened. This method presents many challenges, including exposure of the person's skin to chemicals in the acetone. Further, this method also causes direct exposure to harmful and hazardous fumes from the removing solution.

Other methods for removing acrylic or gel coatings involve the use of a clip, similar to a clothing pin, and a pad with removing solution, such as acetone, placed on the tip of the fingers or toes. The problem with these devices is that the clips are neither flexible nor bendable. These clips squeeze and compress the fingers or toes making uncomfortable to remove acrylic or gel from the nail bed. Additionally, the open nature of the clip allows for hazardous fumes of the removing solution to escape the clip exposing not only the person getting the acrylic or gel removed, but people in the surrounding area to these dangerous fumes.

In fact, due to the use and daily exposure of hazardous chemicals in the nail profession, the United States Occupational Safety and Health Administration (OSHA) recommends nail technicians to wear personal protective equipment, such as respirators, face masks, and gloves. OSHA further recommends for nail technicians to use ventilation equipment to protect themselves against exposure from hazardous chemicals, solvents and airborne powders that are currently used to apply and remove acrylic and/or gel nail coatings.

As illustrated by the above, there is a need for a self-contained, leak-proof device for the removal of nail-enhancement products from fingernails or toenails. Currently disclosed is a method and device providing a safer and easier way for removing nail products, such as gel and acrylic, from nail beds. The currently disclosed method and device provide a way to reduce the exposure to hazardous chemicals improving safety for nail technicians, their co-workers, their clients, and work environment, and individuals removing their own nail-enhancement products. Moreover, the currently disclosed method and device provide for the safe disposal of nail-enhancement products and by-products as the device is self-contained and adapted to capture excess removing solution inside the same.

Furthermore, the currently disclosed method and device provides a barrier between the user of the device (i.e. client) and the nail technician performing nail services as the device minimizes direct contact between the two individuals. Additionally, as the currently disclosed method and device does not require submerging fingernails or toenails in removing solution, the device allows the user to use their hands while using the device. For example, the device allows the user to use a mobile device, such as a cellphone, while using the device.

Currently disclosed is a self-contained device for the removal of nail-enhancement products, such as acrylic and/or gel, comprising a flexible body, the flexible body comprising an internal cavity axially passing there through; a closed-end portion, said closed-end portion comprising a reservoir portion positioned at a proximal end of the flexible body; and an open-end portion, said open-end portion comprising an extendable fitted ring-like portion positioned at a distal end of the flexible body. The closed-end portion may have a narrower diameter than the open-end portion.

The self-contained device may further comprise an absorbent pad, said absorbent pad positioned in the internal cavity of the flexible body between the closed-end portion and the open-end portion. The absorbent pad may be removable from the self-contained device. Alternatively, or in addition, the absorbent pad may be fastened to the internal cavity of the flexible body by fastening means, such as self-adhesive. The absorbent pad is adapted to hold nail-enhancement products removal solution, such as acetone. The absorbent pad may be a cotton pad. Alternatively, or additionally, the absorbent pad may be a fabric or cloth pad.

The flexible body of the self-contained device may further comprise an opening, said opening providing direct access to the absorbent pad. The opening may be a crosscut opening. Alternatively, or in addition, the flexible body of the self-contained device may further comprise a lid on top of the opening. Said lid may be open or closed providing access to the absorbent pad through the opening.

Further disclosed is a method for removing nail-enhancement products from nail beds comprising the steps of: wetting an absorbent pad with a removing solution, placing the wetted absorbent pad on top of a fingernail or a toenail, and placing a self-contained device on finger or toe with the wetted absorbent pad. The self-contained device comprising: a flexible body, a closed-end portion, and an open-end portion. The flexible body comprising an internal cavity axially passing there through. The closed-end portion comprising a reservoir portion positioned at a proximal end of the flexible body. The open-end portion comprising an extendable fitted ring-like portion positioned at a distal end of the flexible body securing the self-contained device to the finger or toe. The flexible body made of a more rigid material than that of the reservoir portion and that of the extendable fitted ring-like portion.

The flexible body may further comprise an opening. Additionally, the flexible body may further comprise a lid on top of the opening covering the same. Said lid may be detachable. Alternatively, the lid may be semi-detachable.

The self-contained device is then placed on the finger or toe so that the flexible body and the wetted absorbent pad are in direct contact. Then, the method for removing nail-enhancement products from a fingernail or toenail comprises the step of sliding the extendable fitted ring-like portion of the open-end portion down the finger or toe. Additionally, the method may comprise the step of placing at least one fitted ring on the open-end portion further securing the self-contained device to the finger or toe. Alternatively, or in addition, the method may comprise the step of sliding at least one seal fitted ring down the self-contained device to the open-end portion further securing the self-contained device to the finger or toe.

The method further comprises the steps of leaving the self-contained device with the wetted absorbent pad on top of fingernail or toenail until the nail-enhancement product is loosened, and removing the self-contained device and wetted absorbent pad from finger or toe.

The method may further comprise the step of discarding the self-contained device and wetted absorbent pad. Alternatively, the method may further comprise the step of separating the wetted absorbent pad from the self-contained device and discarding the wetted absorbent pad. The wetted absorbent pad containing the removing solution and removed nail-enhancement product and residues thereof for safe disposal of the same.

Also disclosed is a method for removing nail-enhancement products from a nail bed comprising the steps of wetting an absorbent pad with a removing solution, wherein said absorbent pad is located inside a self-contained device. The self-contained device comprising: a flexible body, a closed-end portion, an open-end portion, and the absorbent pad. The flexible body comprising an internal cavity axially passing there through. The closed-end portion comprising a reservoir portion positioned at a proximal end of the flexible body. The open-end portion comprising an extendable fitted ring-like portion positioned at a distal end of the flexible body securing the self-contained device to the finger or toe.

The flexible body comprises a more rigid material than that of the reservoir portion and that of the extendable fitted ring-like portion. The flexible body may further comprise an opening. Additionally, the flexible body may further comprise a lid on top of the opening. Said lid may be detachable. Alternatively, the lid may be semi-detachable.

The absorbent pad is positioned in the internal cavity of the flexible body between the closed-end portion and the open-end portion. The absorbent pad may be removable from the self-contained device. Alternatively, or in addition, the absorbent pad may be fastened to the internal cavity of the flexible body by fastening means, such as self-adhesive. The absorbent pad is adapted to hold nail-enhancement products removal solution, such as acetone. The absorbent pad may be a cotton pad. Alternatively, or additionally, the absorbent pad may be a fabric pad.

The method further comprises the steps of placing the self-contained device on finger or toe with the wetted absorbent pad laying on top of nail bed and sliding the extendable fitted ring-like portion of the open-end portion down the finger or toe securing the self-contained device to the finger or toe. Additionally, the method may comprise the step of sliding at least one fitted ring down the self-contained device to the open-end portion further securing the self-contained device to the finger or toe.

The method further comprises the step of leaving the self-contained device with the wetted absorbent pad on top of the nail bed until the nail-enhancement product is loosened, and removing the self-contained device with the wetted absorbent pad from finger or toe.

The method may further comprise the step of discarding the self-contained device and wetted absorbent pad. Alternatively, the method may further comprise the step of separating the wetted absorbent pad from the self-contained device and discarding the wetted absorbent pad, the wetted absorbent pad containing the removed nail-enhancement products, residues, and by-products, such as acetone. Further, the method may comprise the step of replacing the absorbent pad with a new absorbent pad providing for more than one use of the self-contained device. Alternatively, the method may comprise the step of adding a new absorbent pad without removing the already wetted absorbent pad.

Alternatively, or additionally, the method for removing nail-enhancement products from a nail bed may comprise the steps of placing the self-contained device on a finger or a toe, wherein the absorbent pad lays on top of the nail bed of the fingernail or toenail. Then, sliding the extendable fitted ring-like portion of the open-end portion down the finger or toe securing the self-contained device to the finger or toe. Additionally, the method may comprise the step of sliding at least one fitted ring down the self-contained device to the open-end portion further securing the self-contained device to the finger or toe.

The method for removing nail-enhancement products may further comprise the steps of opening the lid covering the opening of the flexible body and wetting the absorbent pad with a removing solution, for example acetone. Then, closing the lid covering the opening of the flexible body, leaving the self-contained device with the wetted absorbent pad on top of the nail bed until the nail-enhancement product is loosened, and removing the self-contained device with the wetted absorbent pad from finger or toe.

The method may further comprise the step of discarding the self-contained device and wetted absorbent pad. Alternatively, the method may further comprise the step of separating the wetted absorbent pad from the self-contained device and discarding the wetted absorbent pad.

Also disclosed is a device for the removal of nail-enhancement products from nail beds comprising a semi-rigid body, an absorbent pad, and a flexible cover. The semi-rigid body may comprise an adjustable proximal end, a distal end, an external portion, an internal portion, and an aperture passing from the external portion to the internal portion. The internal portion may include a retaining member. The retaining member may comprise a top part, bottom part and a pair of sidewalls. The bottom part is connected to the internal portion of the semi-rigid body leaving a space between the retaining member and the internal portion.

The absorbent pad is positioned in the internal portion of the semi-rigid body between the retaining member and the distal end. The absorbent pad may be placed in a space between the internal portion of the semi-rigid body and the retaining member. The absorbent pad may be any pad compatible with removing solution, for example, a cotton pad or a foam pad. The foam pad may further include centrally located perforations. The centrally located perforations allow the rapid absorption of removing solution and facilitate the addition of removing solution to the foam pad while preventing the removing solution from splattering outside the foam pad.

The absorbent pad is positioned in direct contact with the fingernail or toenail from which nail-enhancement product is going to be removed. The absorbent pad collects the removed nail-enhancement product and any associated residue.

The flexible cover comprises an internal cavity passing there through, a closed-end portion, an open-end portion, an opening, and a lid. The flexible cover is adapted to surround and cover the semi-rigid body and absorbent pad. The flexible cover is also adapted to surround the finger or toe with the semi-rigid body and absorbent pad. The flexible cover molds to both the shape of the semi-rigid body and to the shape of the finger or toe.

The flexible cover may comprise a lid. The lid is a removable attached cover located on top of the opening of the flexible cover. The lid may be completely detachable or semi-detachable from the flexible cover. The lid is adapted to align with the aperture of the semi-rigid body.

The open-end portion of the flexible cover may be extendable. The open-end portion may be placed in a rolled up position against the bottom part of the semi-rigid body. Alternatively, or in addition, the open-end portion of the flexible cover may be extended down the length of the finger or toe.

Also disclosed is a method for the removal of nail-enhancement product from nail beds. The method comprising the step of placing a device on a finger or toe, wherein the device comprises a semi-rigid body, an absorbent pad, and a flexible cover. The semi-rigid body comprising an adjustable proximal end, a distal end, an external portion, an internal portion, and an aperture passing from the external portion to the internal portion. The semi-rigid body further comprising a retaining member attached to the internal portion of the semi-rigid body. The absorbent pad is positioned in the internal portion of the semi-rigid body between the retaining member and the distal end. The flexible cover comprises an internal cavity axially passing there through, a closed-end portion, an open-end portion, an opening, and a lid, the flexible cover adapted to surround the semi-rigid body.

The semi-rigid body with the absorbent pad is placed on the finger or toe with the absorbent pad in direct contact with the fingernail or toenail from which nail-enhancement product is desired to be removed. Then, through the internal cavity of the flexible cover, the flexible cover is placed surrounding the semi-rigid body, absorbent pad and finger or toe.

Alternatively, the semi-rigid body with the absorbent pad are both placed inside the internal cavity of the flexible cover. Then, the flexible cover with the semi-rigid body and absorbent pad, as a whole, are placed on the finger or toe. The absorbent pad is placed in direct contact with the fingernail or toenail from which nail-enhancement product is desired to be removed.

In any case, the aperture of the semi-rigid body is placed on top of the absorbent pad allowing access to the absorbent pad from the external portion of the semi-rigid body. The absorbent pad is positioned between the distal end and the retaining member of the semi-rigid body. Further, the opening and lid of the flexible cover are aligned with the aperture of the semi-rigid body providing direct access to the absorbent pad through said aperture.

The open-end portion of the flexible cover may remain in a rolled-up position against the bottom end of the semi-rigid body. Alternatively, or additionally, the open-end portion of the semi-rigid body may be extended throughout the length of the finger or toe.

After the device, i.e. semi-rigid body, the absorbent pad and flexible cover, is placed on the finger or toe, removing solution is added to the absorbent pad through the aperture of the semi-rigid body. The opening of the flexible cover is opened providing access to the absorbent pad through the aperture of the semi-rigid body. Once the solution is added, the lid of the flexible cover is closed encapsulating the fumes of the removing solution inside the flexible cover.

The device with the wetted absorbent pad is left on top of the nail bed until the nail-enhancement product is loosened. Alternatively, or additionally, additional removing solution may be added to the absorbent pad. The lid of the flexible cover is opened providing access to the absorbent pad. Additional removing solution is added, the lid is then closed and the device with the wetted absorbent pad is left on top of the fingernail or toenail for an extended time.

The closed-end portion of the flexible cover may include a reservoir tip. After adding removing solution to the absorbent pad, the user may slightly tilt the finger or toe causing any excess removing solution to be collected in the reservoir tip. The reservoir tip prevents excess removing solution from reaching other parts of the finger or toe, in turn, reducing direct exposure to the hazardous solution.

Once the nail-enhancement products is loosened from the nail bed, the nail-enhancement product and associated residues adhere to the absorbent pad and remain contained inside the device. The device as a whole, flexible cover, semi-rigid body and absorbent pad, is removed from the finger or toe. Alternatively, the flexible cover is removed first. Then, the semi-rigid body and the absorbent pad with the removed nail-enhancement product and residues are removed from the finger or toe.

BRIEF DESCRIPTION OF THE DRAWINGS

Further features of the inventive embodiments will become apparent to those skilled in the art to which the embodiments relate from reading the specification and claims with reference to the accompanying drawings, in which:

DETAILED DESCRIPTION OF THE DRAWINGS

Figure 1:
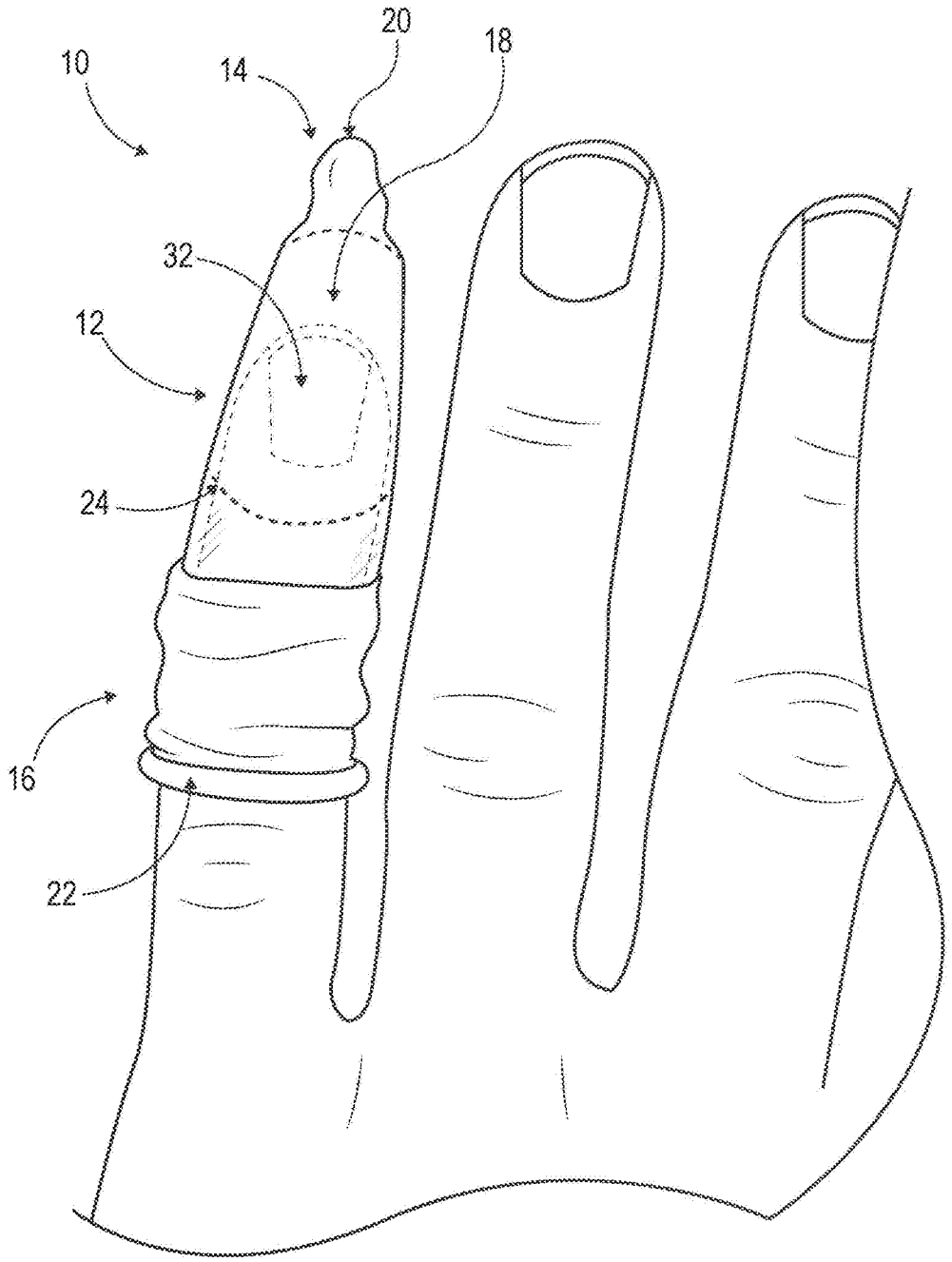
FIG. 1 illustrates a self-contained device for the removal of nail-enhancement products.

The currently disclosed device and method for the removal of nail-enhancement products from nail beds may be used on both fingers and toes. For the purpose of this description, the term "digit" refers to any "finger" or "toe." The term nail bed refers to any "fingernail" or "toenail." The currently disclosed device and method provide for the removal and capture of nail-enhancement products, such as nail gel and nail acrylic, and associated residues, such as removing solution (e.g. acetone), in a safe, efficient, and quick manner. The currently disclosed device and method provide for the safe removal of nail-enhancement products from nail beds and disposal of the same without leakage of and exposure to hazardous chemicals and fumes.

FIGS. 1-7 illustrate a self-contained device 10 for the removal of nail-enhancement products from a nail bed 32 comprising a flexible body 12, a closed-end portion 14 and an open-end portion 16. The flexible body 12 comprises an internal cavity 18 axially passing there through. The closed-end 14 comprises a reservoir portion 20 positioned at a proximal end of the flexible body 12. The reservoir portion 20 adapted to capture excess nail-enhancement product waste and extra removing solution. The open-end portion 16 comprises an extendable fitted ring-like portion 22 positioned at a distal end of the flexible body 12.

Figure 5:
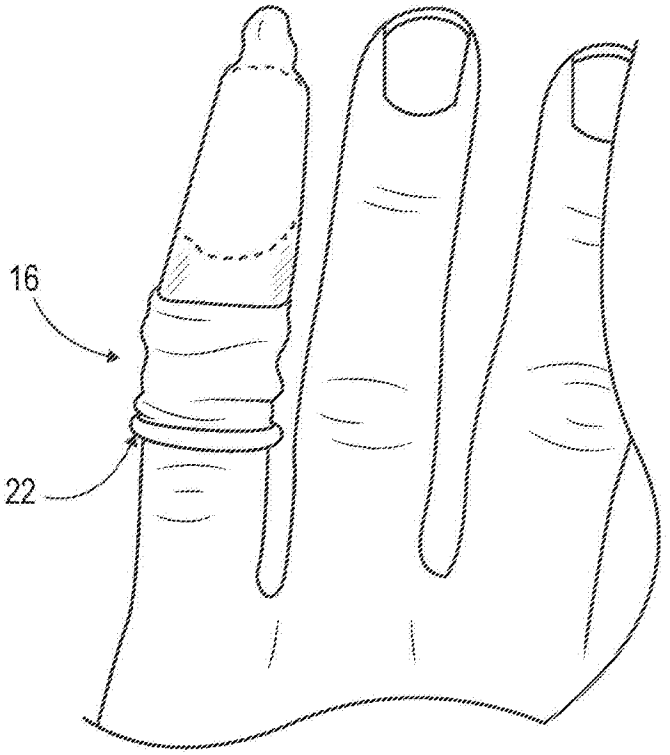
FIG. 5 illustrates a self-contained device for the removal of nail-enhancement products with extendable fitted ring-like portion in extended position.
Figure 6:
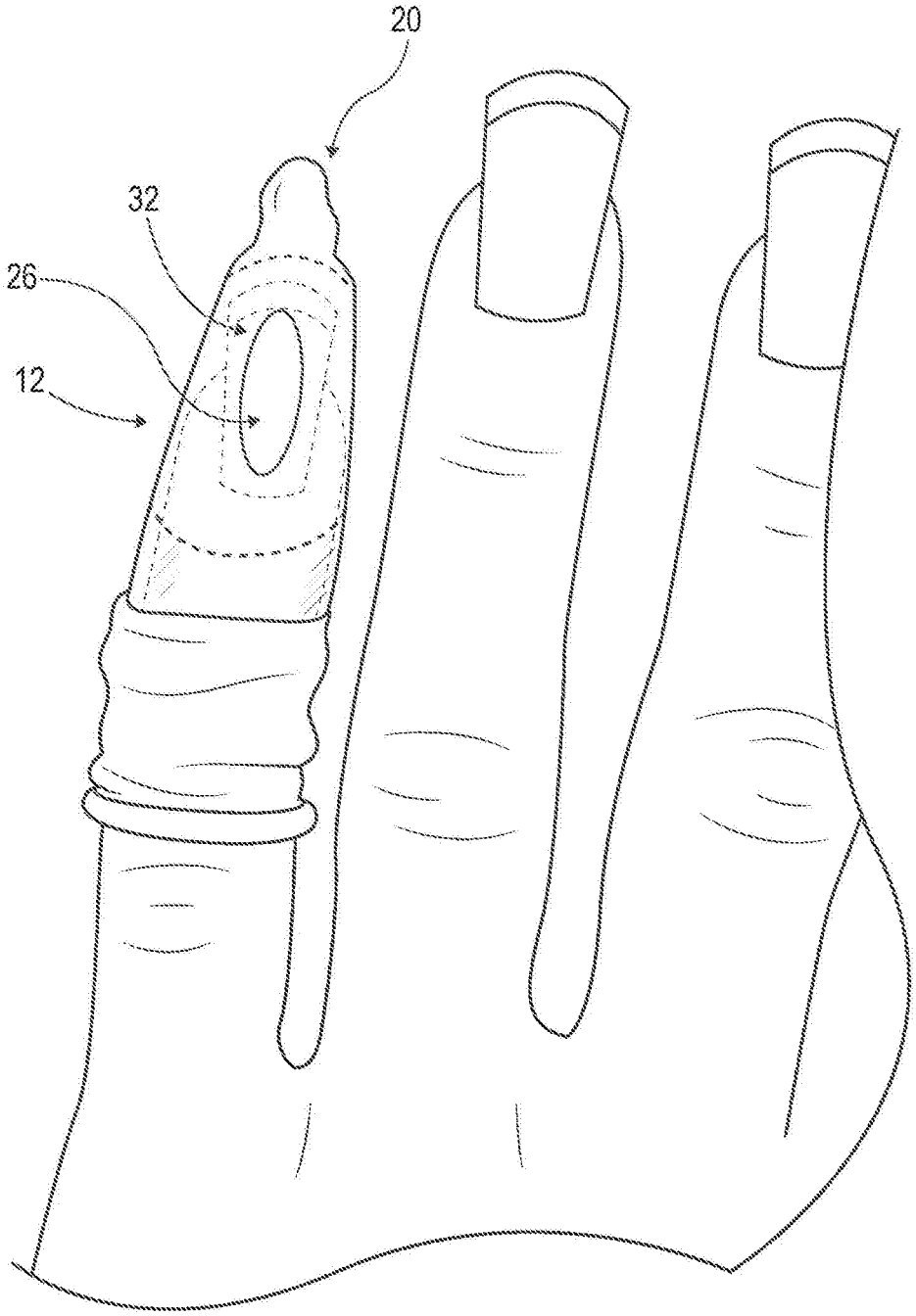
FIG. 6 illustrates a self-contained device for the removal of nail-enhancement products.
Figure 7:
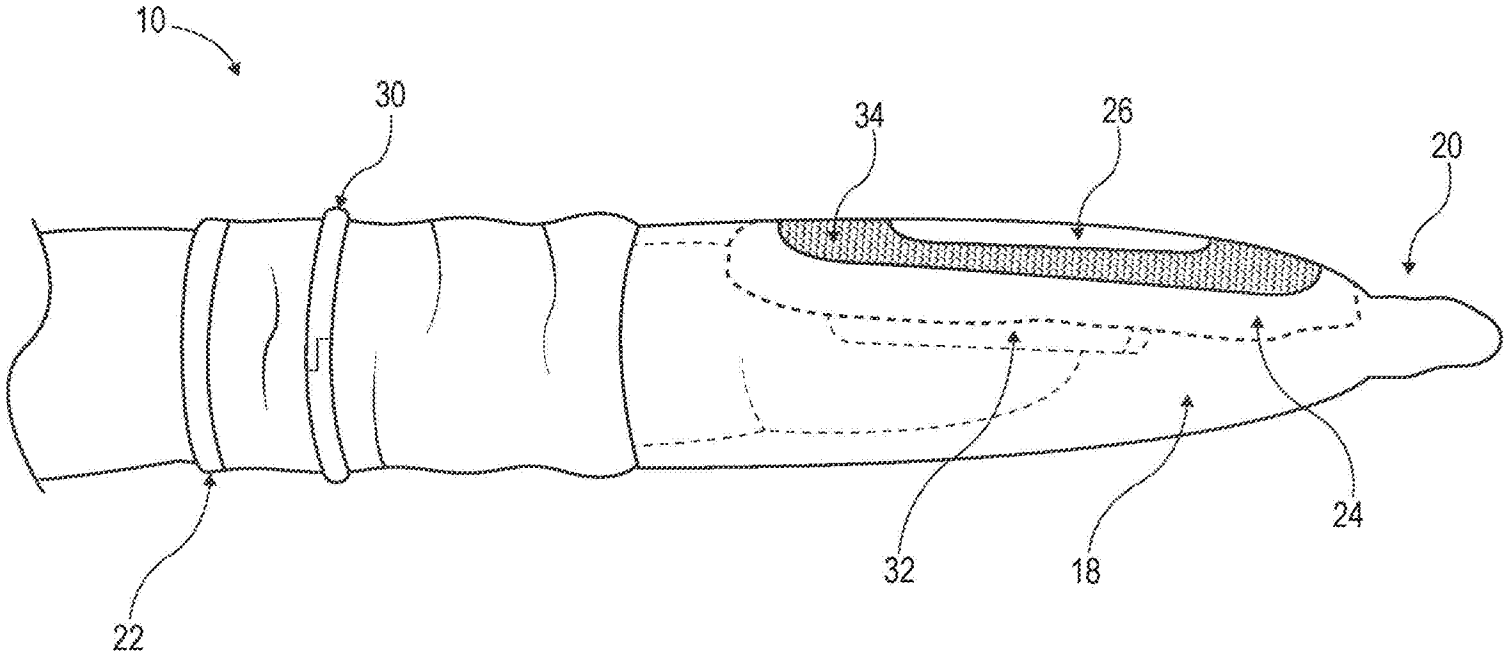
FIG. 7 illustrates a side-view of a self-contained device for the removal of nail-enhancement products.
Figure 8:
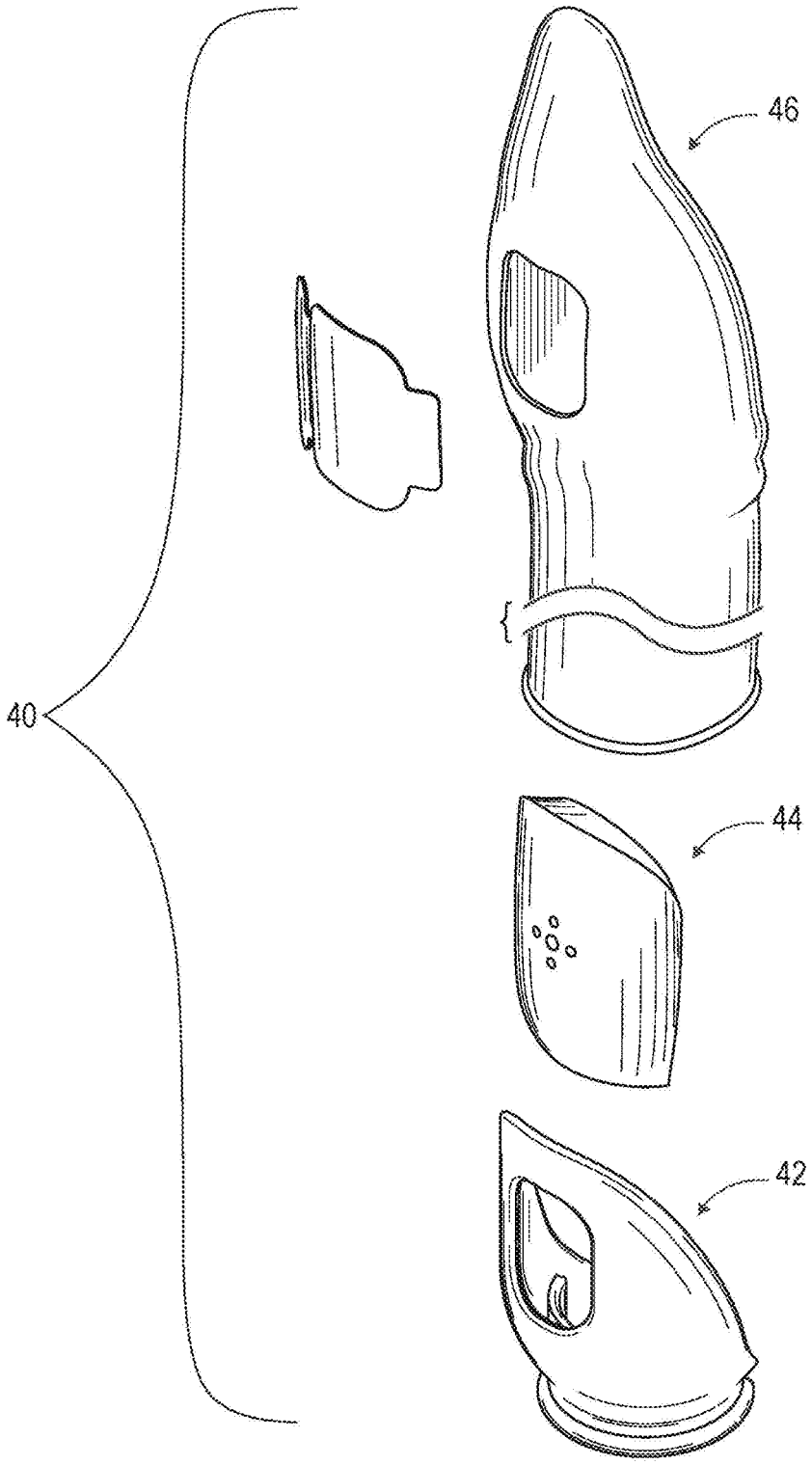
FIG. 8 illustrates a device for the removal of nail-enhancement products.
Figure 9:
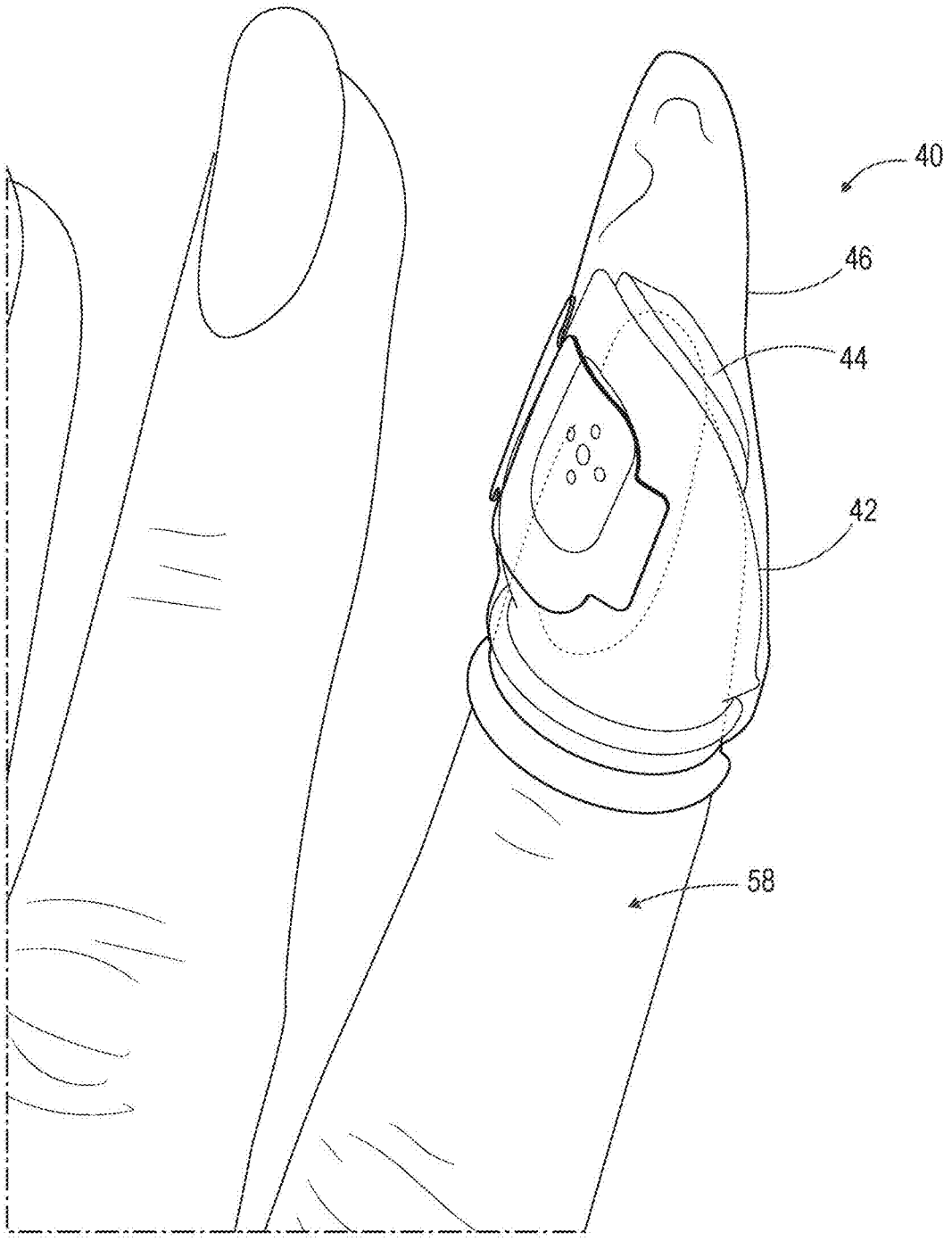
FIG. 9 illustrates a device for the removal of nail-enhancement products.
Figure 10:
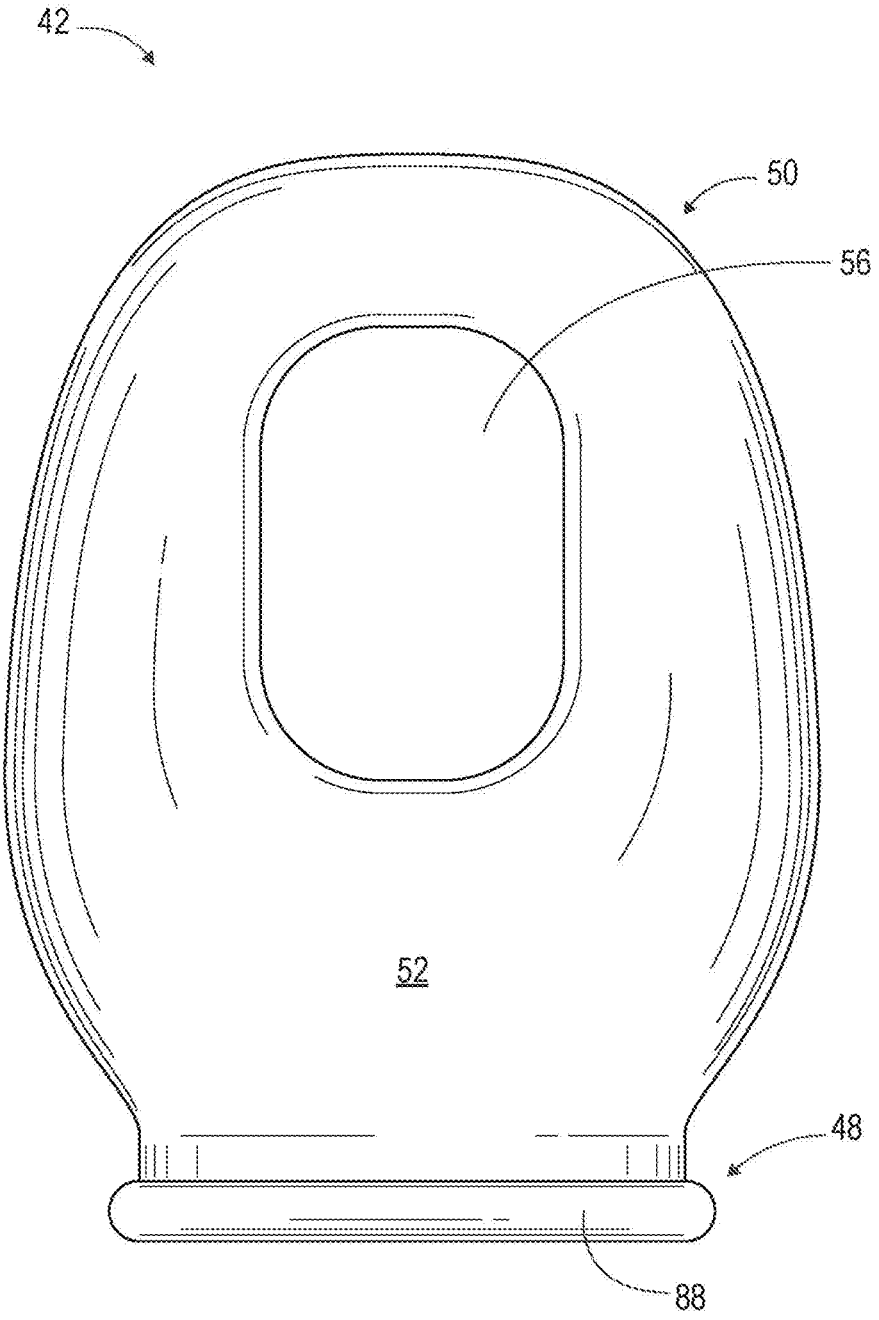
FIG. 10 illustrates a front view of a semi-rigid body of a device for the removal of nail-enhancement products.
Figure 11:
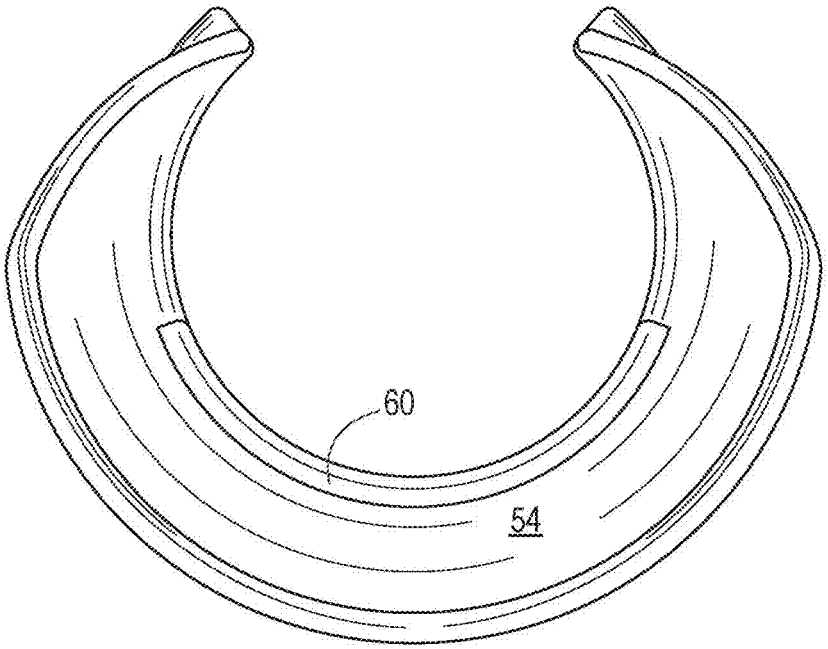
FIG. 11 illustrates a top view of a semi-rigid body of a device for the removal of nail-enhancement products.
Figure 12:
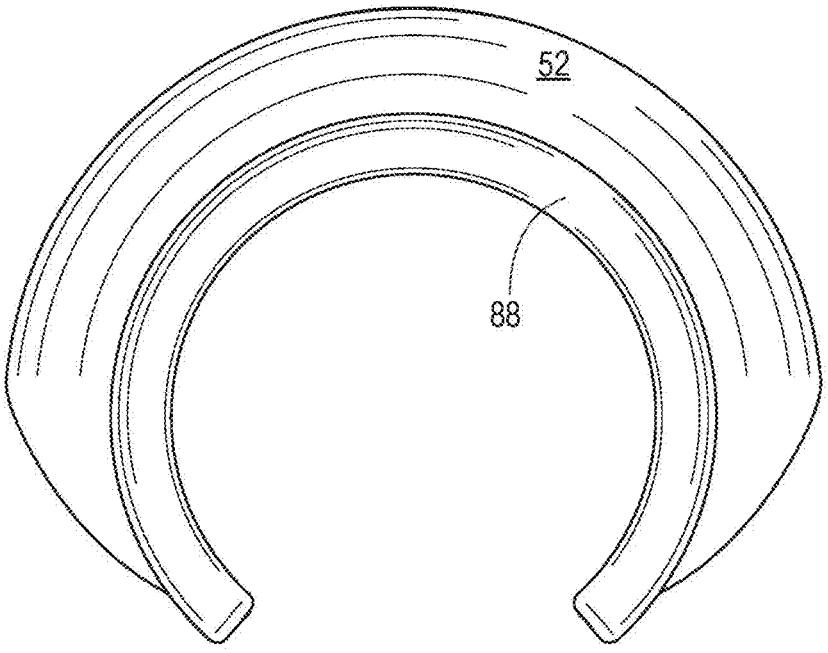
FIG. 12 illustrates a bottom view of a semi-rigid body of a device for the removal of nail-enhancement products.

As illustrated in FIGS. 1-7, the self-contained device 10 may further comprise an absorbent pad 24. The absorbent pad 24 is positioned in the internal cavity 18 of the flexible body 12 between the closed-end portion 14 and the open-end portion 16. As shown in FIG. 7, the absorbent pad 24 may be fastened to the internal cavity 18 of the flexible body 12 by fastening means 34. The internal cavity of the flexible body may include a fabric strip, for example nylon, with a surface comprising of tiny loops or hoops that fasten to the absorbent pad.

Figure 2:
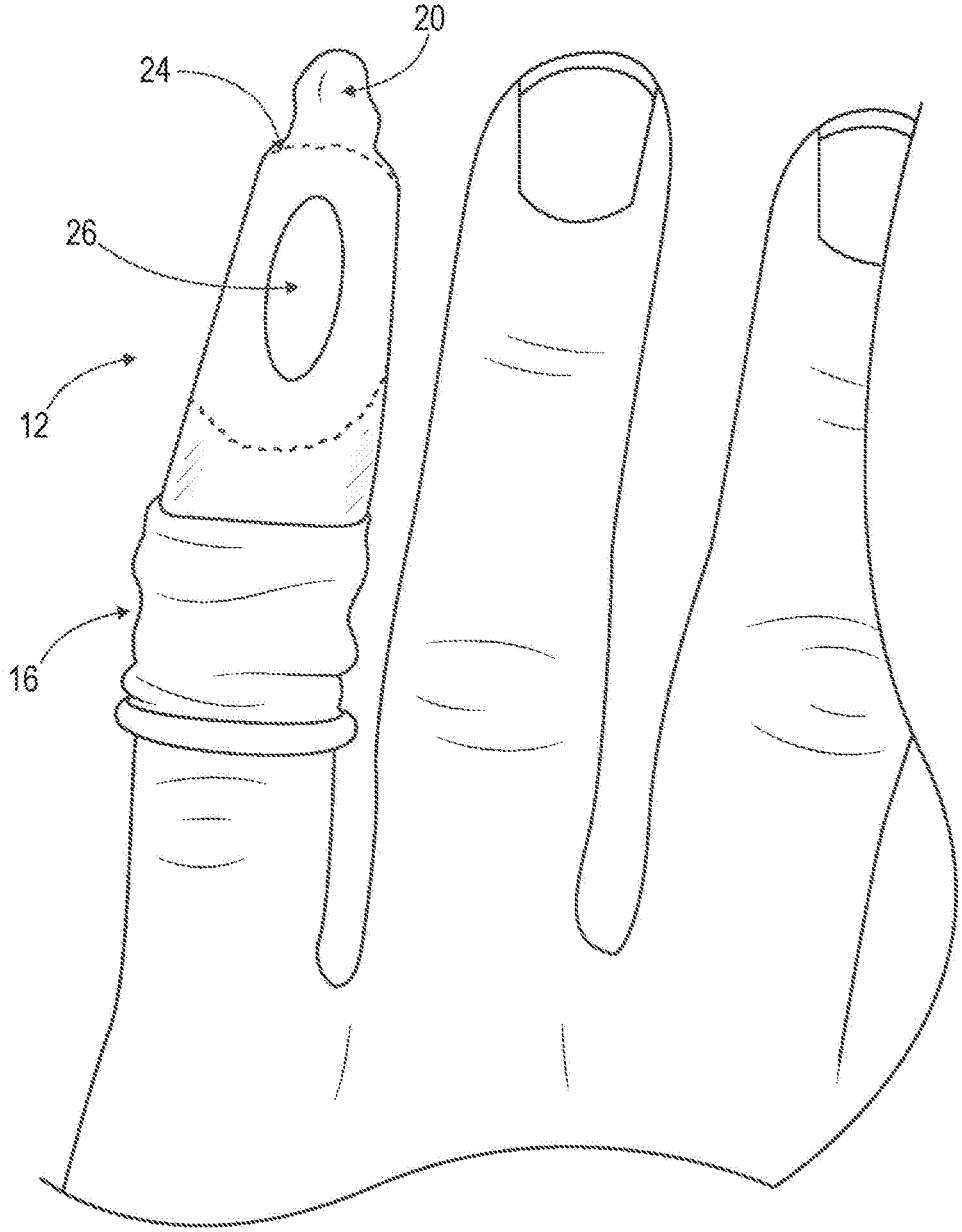
FIG. 2 illustrates a self-contained device for the removal of nail-enhancement products.
Figure 3:
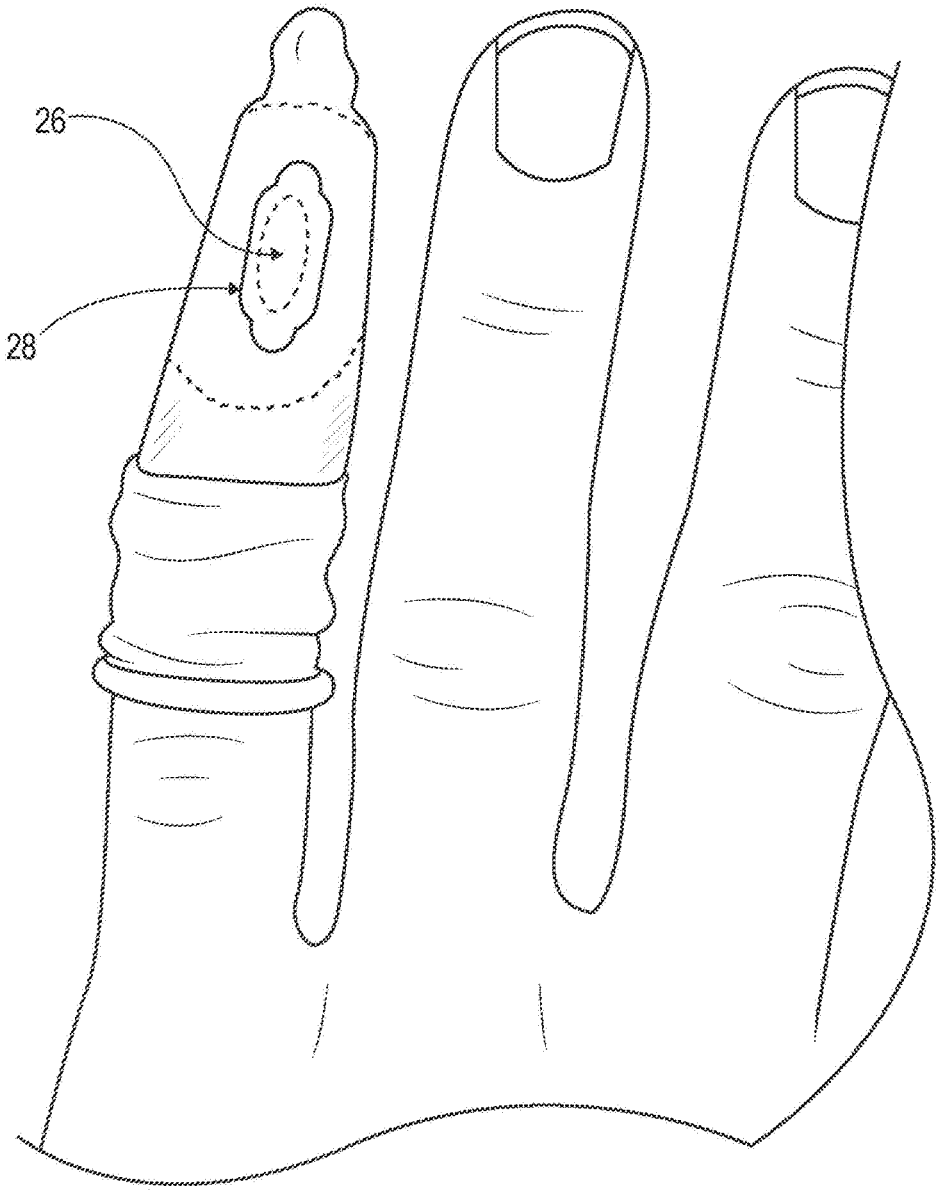
FIG. 3 illustrates a self-contained device for the removal of nail-enhancement products.

As shown in FIGS. 2-3, the flexible body 12 may further comprise an opening 26. Additionally, the flexible body 12 may further comprise a lid 28 covering opening 26. Said lid may be fastened to the flexible body by self-adhesive means, for example glue. Lid 28 may be completely detachable from the flexible body. Alternatively, the lid 28 may be semi-detachable from the flexible body.

As illustrated in FIGS. 1-7, self-contained device 10 is placed on a digit, either finger or toe, through the internal cavity 18 of the flexible body 12. The flexible body may be made out of stretchable material, for example latex rubber, wherein said material is resistant to acrylic or gel removing solution, e.g. acetone. The flexible body 12 is more rigid than the reservoir portion 20 and the extendable fitted ring-like portion 22. The flexible body material is also thicker than both the reservoir portion material and the extendable fitted ring-like material. The higher rigidity and thickness of the flexible body provides for the secure placement of the absorbent pad 24 on top of the nail bed 32. As shown, flexible body 12 allows the self-contained device to be able to accommodate different nail lengths.

Figure 4:
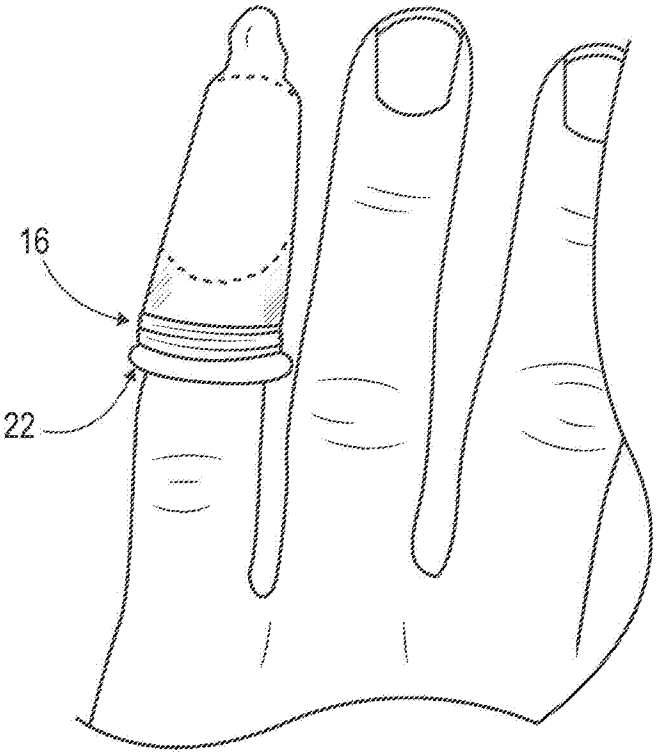
FIG. 4 illustrates a self-contained device for the removal of nail-enhancement products with extendable fitted ring-like portion in rolled-up position.

The open-end portion 16 of the self-contained device 10 comprises an extendable fitted ring-like portion 22. As shown in FIGS. 4 and 5, the extendable fitted ring-like portion 22 may be extended securing the self-contained device 10 to the finger or toe creating a snug, comfortable fit and seal for a leak-proof application. FIG. 4 illustrates the extendable fitted ring-like portion 22 in a rolled-up position. FIG. 5 illustrates the extendable fitted ring-like portion 22 in an extended position.

As shown in FIG. 7, the open-end portion 16 may further comprise at least one fitted ring 30. The at least one fitted ring 30 further secures the self-contained device 10 to the finger or toe while also providing a comfortable and leak-proof seal. The at least one fitted ring is adapted to prevent further leakage of the removing solution; therefore, further decreasing the exposure to hazardous chemicals. The at least one fitted ring may comprise rings of different sizes. Alternatively, or in addition, the at least one fitted ring may be customizable to the finger's or toe's diameter. The at least one fitted ring may be secured to the self-contained device. Alternatively, or in addition, the at least one fitted ring may be detachable from the self-contained device.

The closed-end 14 of the self-contained device 10 comprises reservoir portion 20. As illustrated in FIG. 6, reservoir portion 20 has a smaller diameter than flexible body 12. The reservoir portion 20 and the extendable fitted ring-like portion 22 are less rigid than flexible body 12. The greater flexibility of the reservoir portion allows for the capture of any excess removing solution.

As shown in FIG. 7, the absorbent pad 24 lays on top of the nail bed 32. The absorbent pad 24 is adapted to hold a solution for the removal of nail-enhancement products, such as acetone. The removing solution may be added to the absorbent pad before the self-contained device is placed on the finger or toe. Alternatively, or in addition, the removing solution may be added to the absorbent solution after the self-contained device is placed on the finger or toe.

For example, the self-contained device 10 is placed on a finger or toe through the internal cavity 18 of the flexible body 12, wherein the absorbent pad 24 lays on top of the nail bed. Removing solution is added to the absorbent pad 24 through the opening 26 wetting the absorbent pad. Further, if the flexible body includes a lid 28, once the absorbent pad is wetted with removing solution, the opening 26 may be covered or sealed with the lid 28. The lid 28 provides further protection from inhalation of removing solution fumes and from evaporation of the removing solution. Additional removing solution may be added to the absorbent pad 24 through the opening 26 as needed.

Once the removing solution is placed on the absorbent pad, the device is left stationary on the finger or toe allowing the nail-enhancement product to loosen enough from the nail bed. The nail-enhancement product and associated residues adhere to the absorbent pad and stay contained inside the flexible body. Then, the self-contained device with the wetted absorbent pad are removed from the finger or toe. The self-contained device with the wetted absorbent pad may be discarded. Alternatively, the wetted absorbent pad may be separated from the self-contained device and discarded leaving the self-contained device for further use.

In another embodiment of the currently disclosed invention for the removal of nail-enhancement products from nail beds, FIGS. 8-25 disclose device 40 comprising a semi-rigid body 42, an absorbent pad 44, and a flexible cover 46. As shown in FIGS. 9-18, the semi-rigid body 42 comprises an adjustable proximal end 48, a distal end 50, an external portion 52, an internal portion 54, and an aperture 56. The adjustable proximal end 48 of the semi-rigid body is adapted to be placed on a digit 58 (i.e., finger or toe). The distal end 50 of the semi-rigid body 42 is adapted to be placed on the tip portion of the finger or toe. The distal end 50 of the semi-rigid body is of semi-oval shape mimicking the shape of a finger or toe. The semi-oval shape of the distal end 50 may provide for further stability for placement of the semi-rigid body on the finger or toe.

The semi-rigid nature of the semi-rigid body provides for the adjustability of the adjustable proximal end to the digit. The adjustable proximal end may be adjusted to the diameter of the finger or toe. The adjustable proximal end 48 of the semi-rigid body may comprise a stabilizing ring member 88. The stabilizing ring member 88 provides for further steadiness of the semi-rigid body to the finger or toe. The stabilizing ring member 88 may be adjusted to the diameter of the finger or toe.

Figure 13:
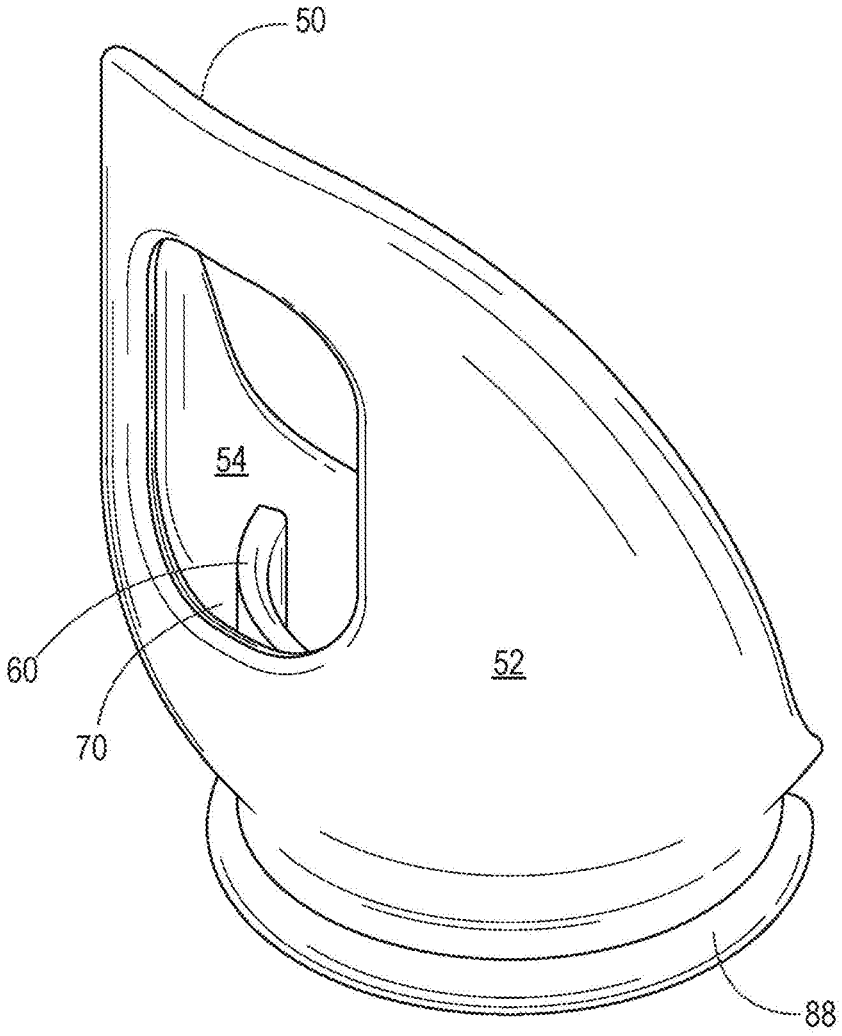
FIG. 13 illustrates a top front right isometric view of semi-rigid body of a device for the removal of nail-enhancement products.
Figure 14:
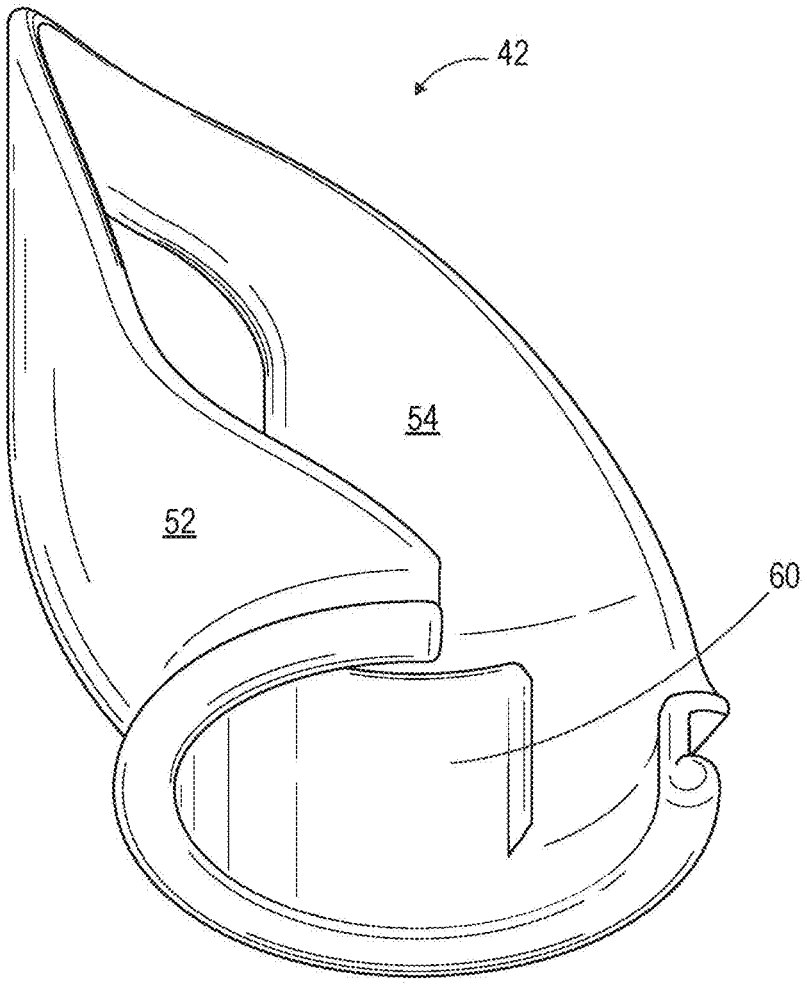
FIG. 14 illustrates a bottom rear left isometric view of a semi-rigid body of a device for the removal of nail-enhancement products.
Figure 15:
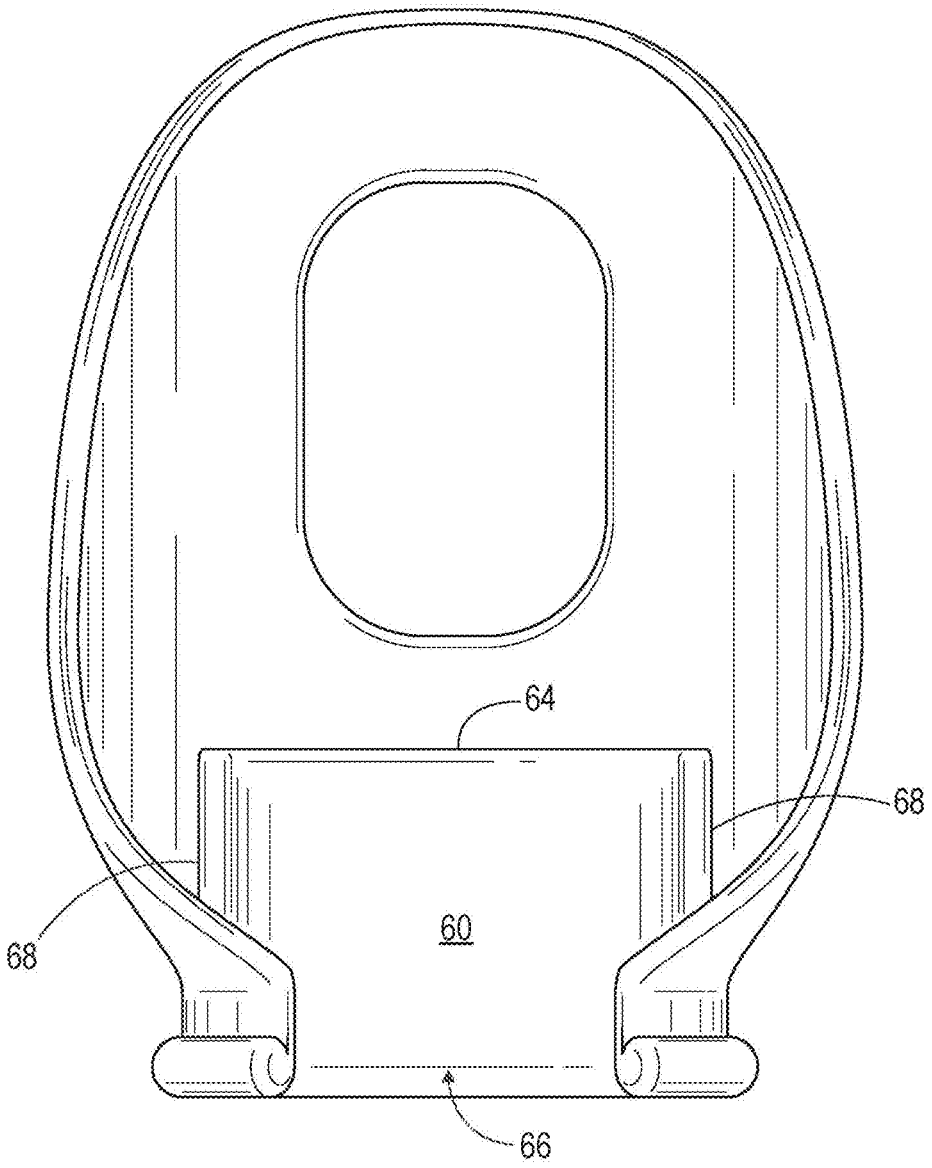
FIG. 15 illustrates a rear view of a semi-rigid body of a device for the removal of nail-enhancement products.

As shown in FIGS. 13-15, the semi-rigid body further comprises a retaining member 60. The retaining member 60 is located in the internal portion 54 of the semi-rigid body. The retaining member 60 comprises a top part 64, bottom part 66, and a pair of sidewalls 68. The bottom part 66 of the retaining member 60 is connected to the internal portion 54 of the semi-rigid body 42 leaving a space 70 between the retaining member and the internal portion providing for the secure placement of the absorbent pad 44 on top of the nail bed 62 of the finger or toe.

Figure 16:
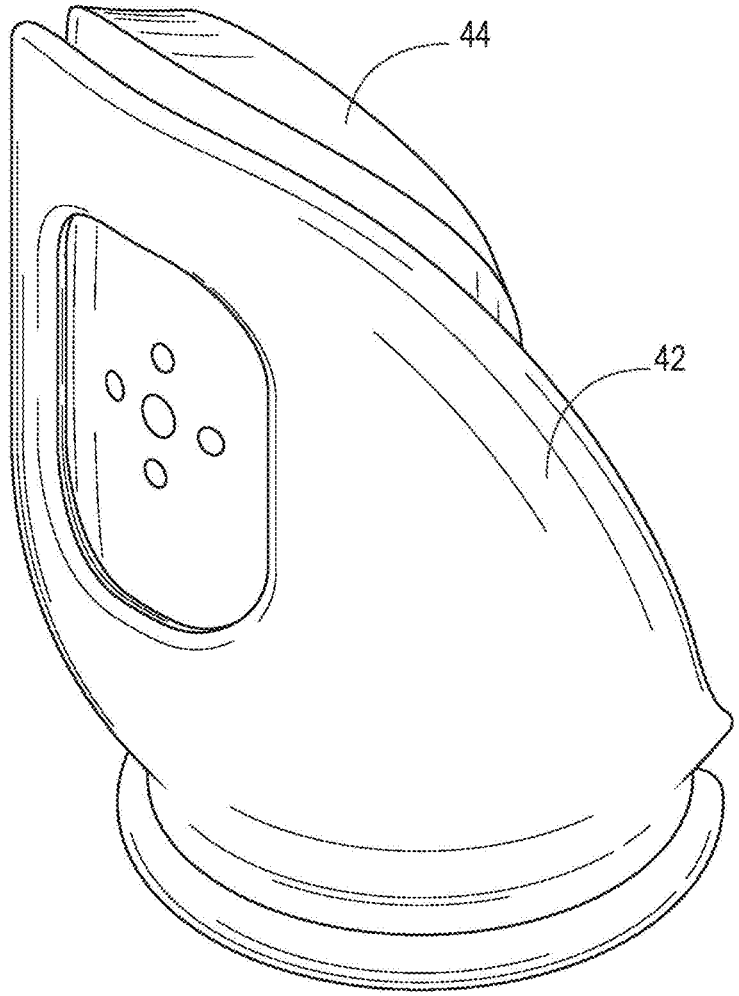
FIG. 16 illustrates a top front right isometric view of a device for the removal of nail-enhancement products.
Figure 17:
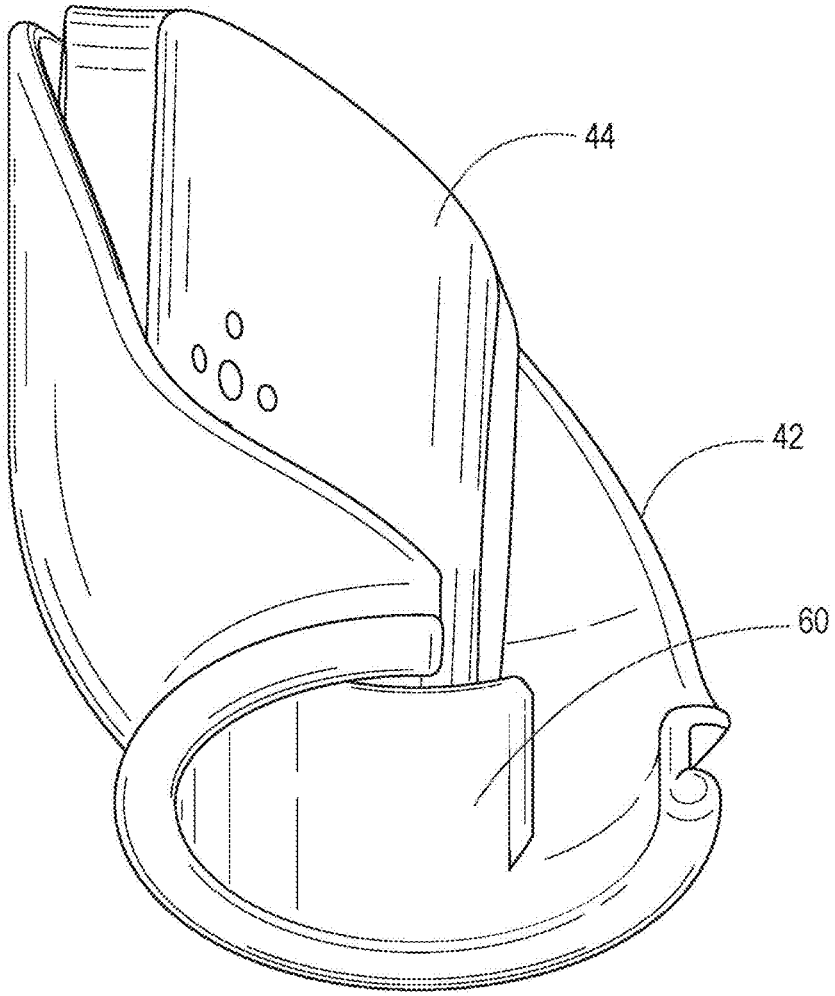
FIG. 17 illustrates a bottom rear left isometric view of a device for the removal of nail-enhancement products.
Figure 18:
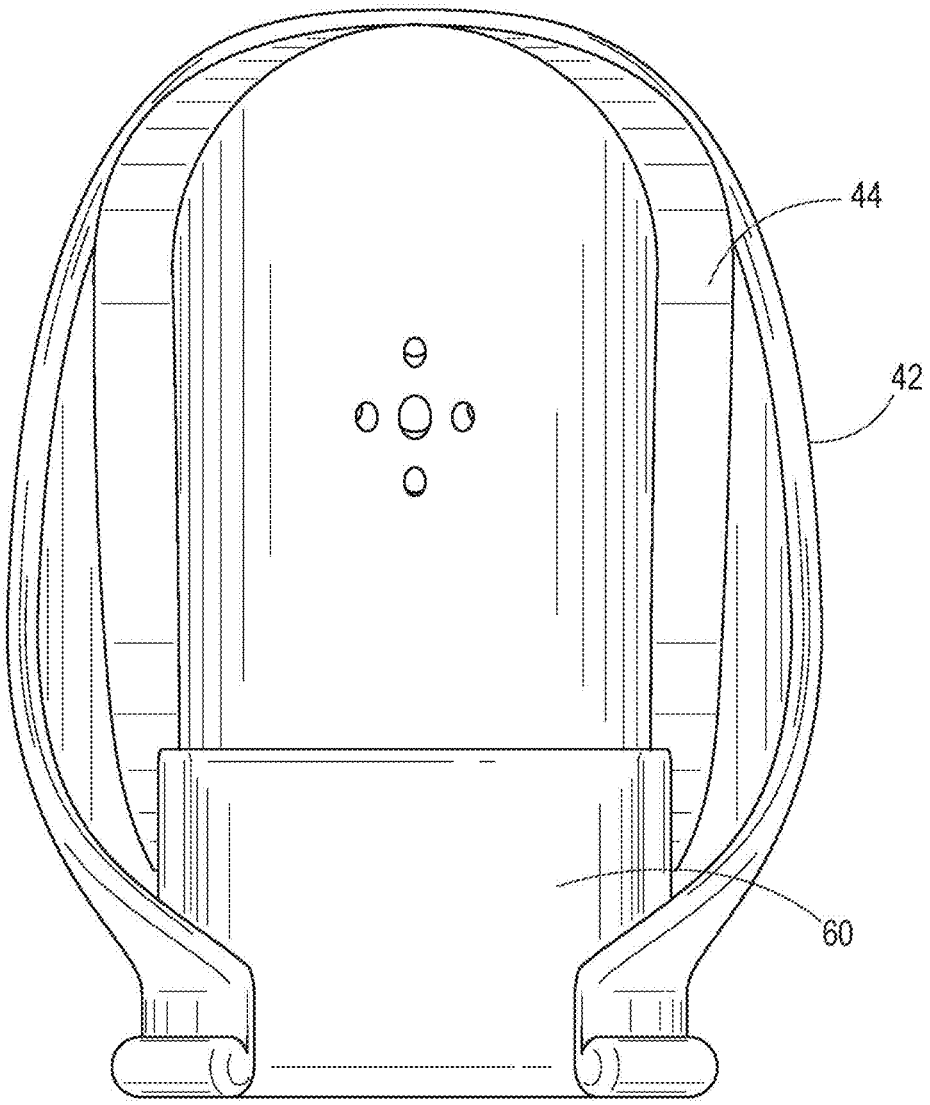
FIG. 18 illustrates a rear view of a device for the removal of nail-enhancement products.

As illustrated in FIGS. 16-18, the absorbent pad 44 is positioned in the internal portion 54 of the semi-rigid body 42 between the distal end 50 and the retaining member 60 positioning the absorbent pad in direct contact with the nail bed 62, either fingernail or toenail. The absorbent pad may comprise of any absorbent material compatible with nail-enhancement removing solution, such as acetone. For example, the absorbent pad may comprise a cotton pad or cloth pad. Alternatively, or additionally, the absorbent pad may comprise a foam pad 72. Although some of the drawings are illustrated with a foam pad in the internal portion of the semi-rigid body, as disclosed and claimed, a cotton pad or a cloth pad may be used.

Figure 19:
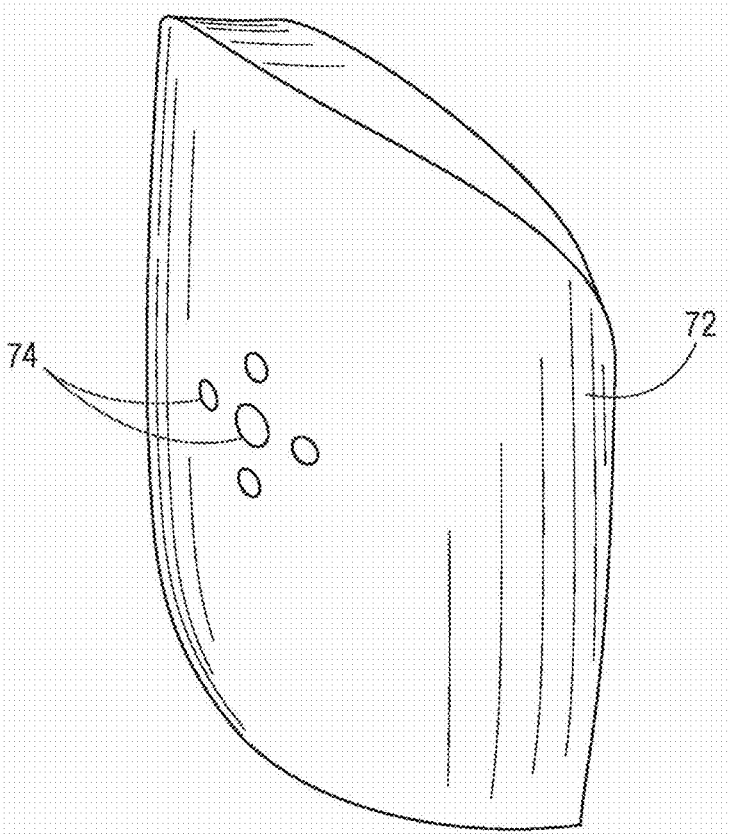
FIG. 19 illustrates an absorbent pad of a device for the removal of nail-enhancement products.
Figure 20:
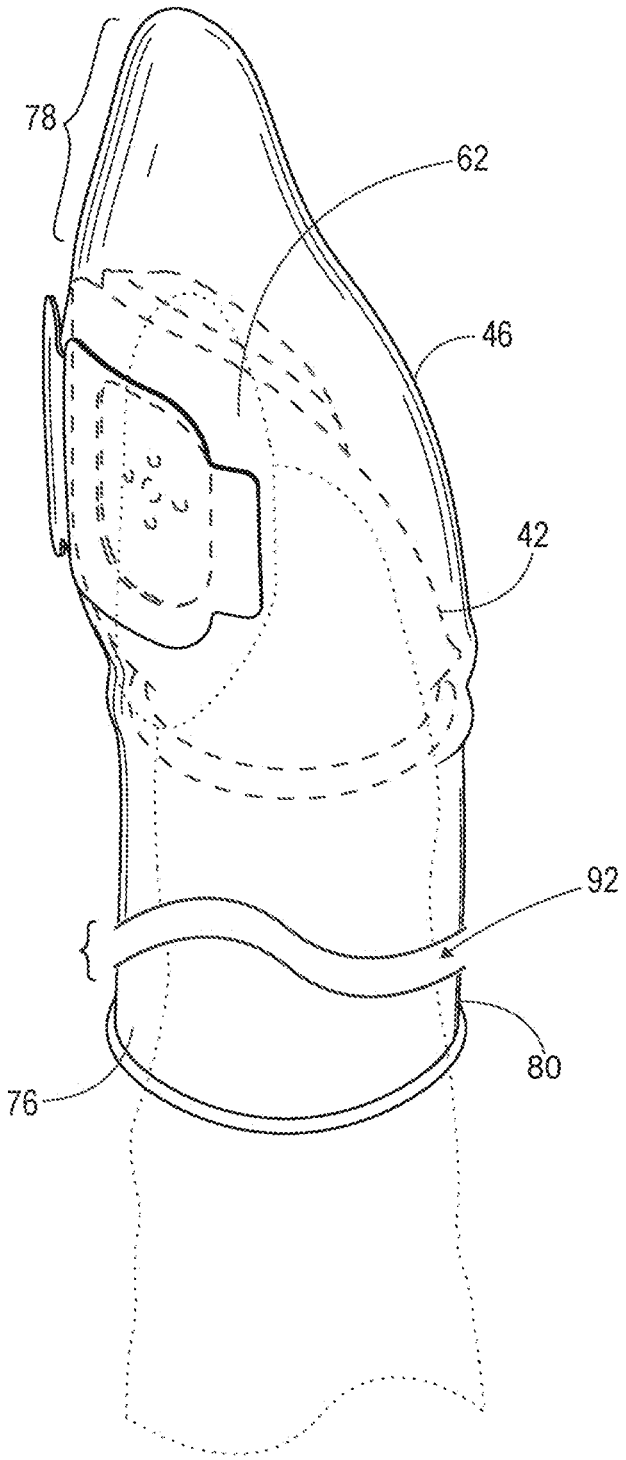
FIG. 20 illustrates a device for the removal of nail-enhancement products.
Figure 21:
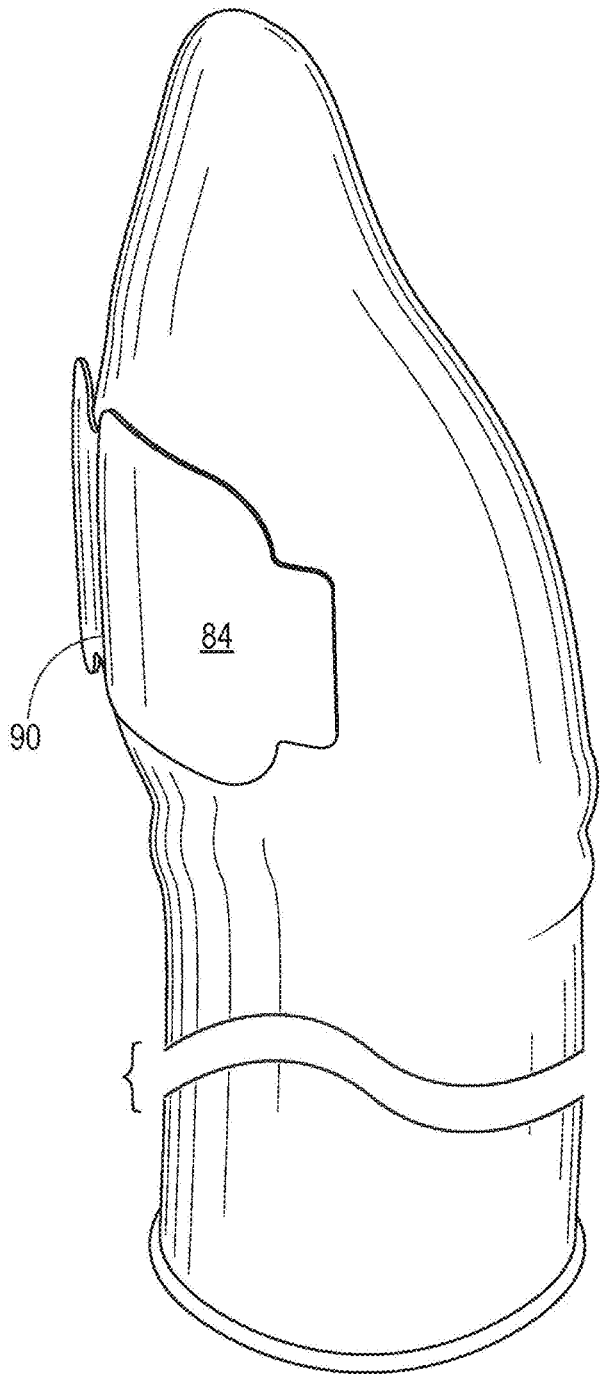
FIG. 21 illustrates a flexible cover of a device for the removal of nail-enhancement products.

As illustrated in FIG. 19, the foam pad 72 may further comprise of centrally located perforations 74. The centrally located perforations 74 provide for the rapid absorption of removing solution. Further, the centrally located perforations 74 facilitate the addition of removing solution to the foam pad while preventing the removing solution to splatter outside the foam pad. Adding removing solution to the foam pad causes the foam pad to expand in size; thus, providing extended coverage area over the fingernail or toenail.

Referring now to FIGS. 20-25, flexible cover 46 is illustrated. The flexible cover 46 is adapted to surround and cover the semi-rigid body 42. The flexibility of the flexible cover allows for the device 40 to be able to accommodate different nail lengths and digit diameters. The flexible cover may be made out of stretchable material, for example latex rubber, wherein said material is resistant to acrylic or gel removing solution, such as acetone.

Figure 23:
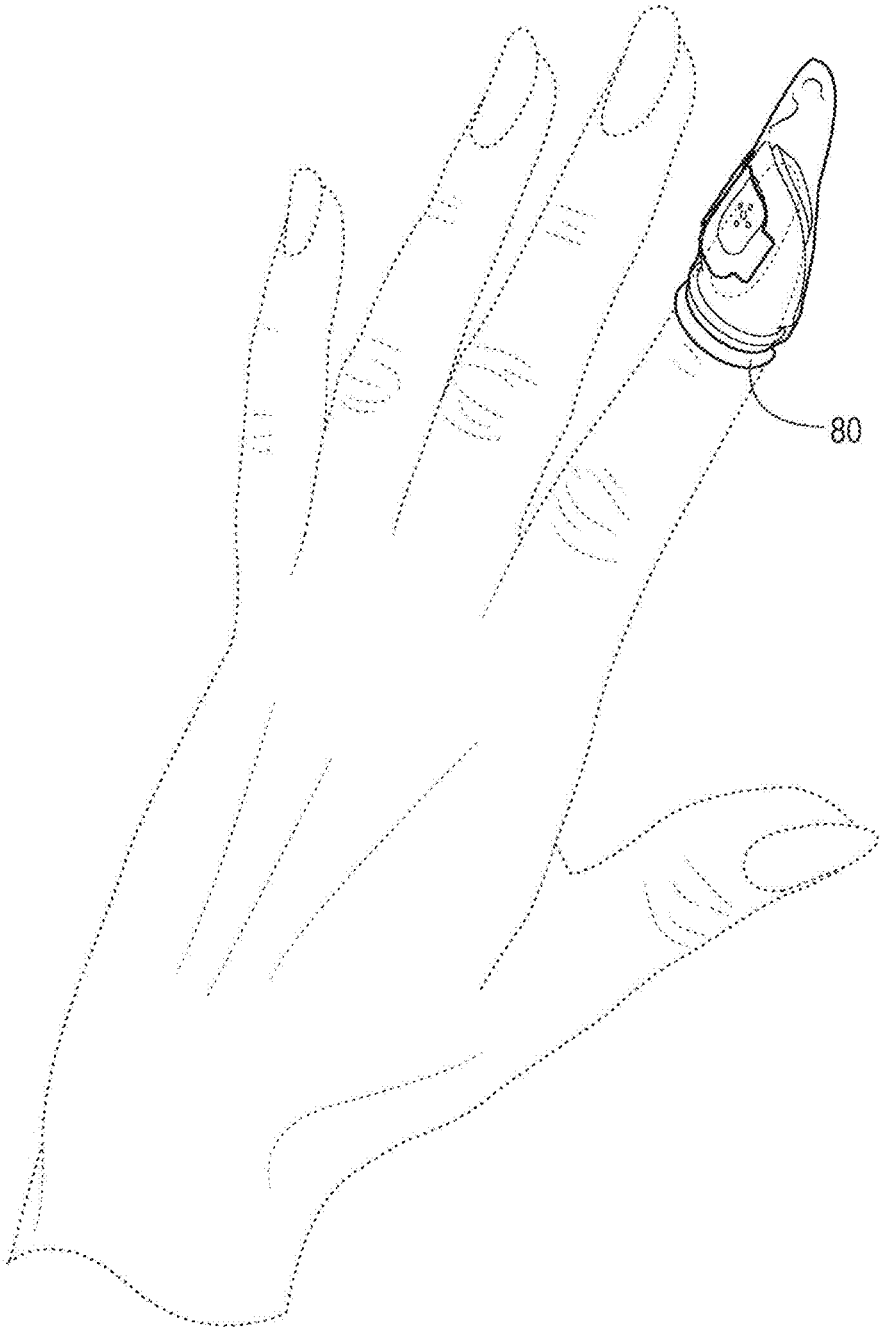
FIG. 23 illustrates a device for the removal of nail-enhancement products.
Figure 24:
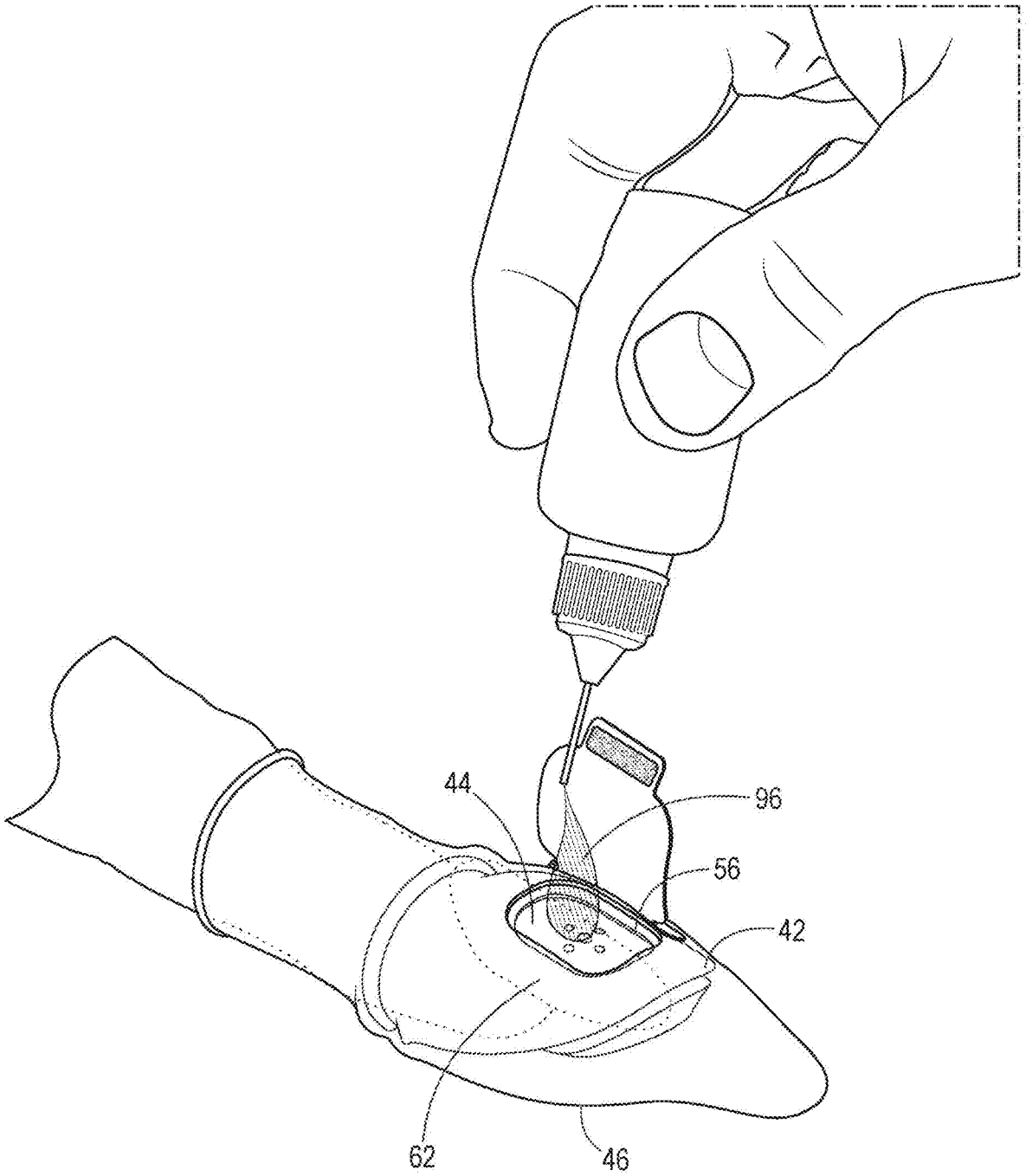
FIG. 24 illustrates addition of removing solution to a device for the removal of nail-enhancement products.

The flexible cover 46 comprises an internal cavity 76 passing there through, a closed-end portion 78, an open-end portion 80, an opening 82, and a lid 84. The open-end portion of the flexible cover is extendable. As shown in FIG. 23, the open-end portion 80 of the flexible cover may be placed in a rolled-up position. Alternatively, or additionally, as shown in FIG. 24, the open-end portion 80 of the flexible cover may be placed in an extendable position down the finger or toe length. Furthermore, as illustrated throughout some of the drawings with a bracket and a separation 92 (see for example, FIG. 20-21), the open-end portion 80 of the flexible cover 46 may vary in length. Extending the length of the open-end portion 80 of the flexible cover 46 down the length of the finger or toe may further prevent leakage of excess removing solution; thus, protecting the user of the device from coming in contact with removing solution.

The closed-end portion 78 of the flexible cover may further comprise a reservoir tip 86. The reservoir tip 86 allows for the capture of any excess removing solution, which in turn reduces exposure to hazardous fumes or solvents.

Figure 22:
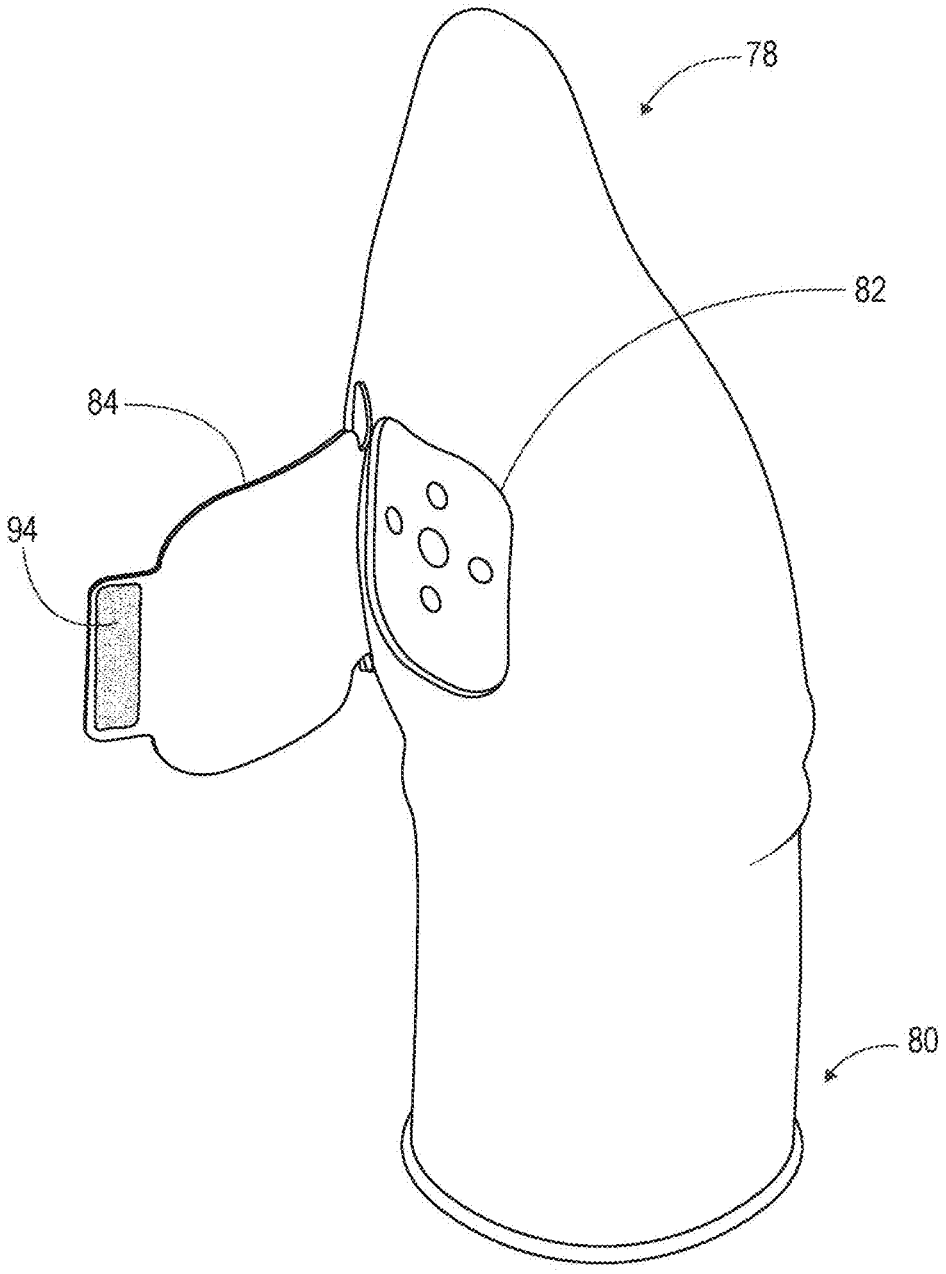
FIG. 22 illustrates a flexible cover of a device for the removal of nail-enhancement products.

As disclosed and claimed, the flexible cover comprises a lid 84. The lid 84 comprises a removably attached cover located on top of the opening 82 of the flexible cover. The lid may be removably attached to the flexible body by self-adhesive means 94, for example, glue. The lid may be completely detachable from the flexible cover. Alternatively, the lid may be semi-detachable from the flexible cover. The lid 84 may further comprise a fold 90. As shown in FIG. 22, said fold 90 provides for the lid to remain in open or semi-open position.

Figure 25:
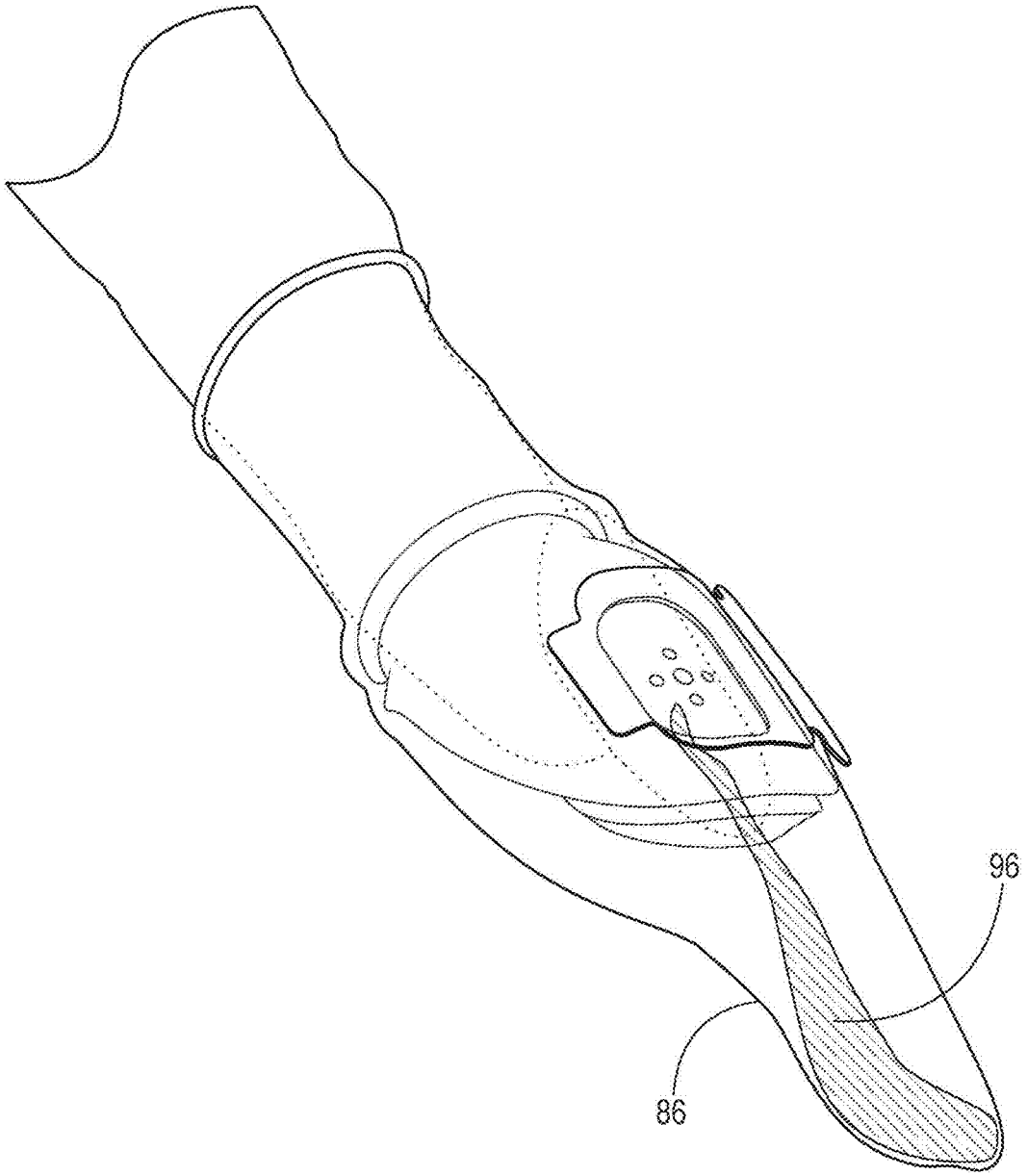
FIG. 25 illustrates a device for the removal of nail-enhancement products.

As illustrated, for example, in FIGS. 23-25, the device 40 is placed on a finger or toe. The absorbent pad is placed in direct contact with the nail bed 62 from which a user desires to remove nail-enhancement product. Then, the aperture 56 of the semi-rigid body is placed on top of the absorbent pad allowing access to the absorbent pad from the external portion of the semi-rigid body. The absorbent pad is positioned between the distal end and the retaining member of the semi-rigid body. The absorbent pad is placed in the space between the internal portion of the semi-rigid body and the retaining member securing the absorbent pad in place.

Alternatively, the absorbent pad is first placed in the internal portion of the semi-rigid body between the distal end and the retaining member. The absorbent pad is placed in the space between the internal portion of the semi-rigid body and the retaining member securing the absorbent pad in place. Then, the semi-rigid body with the absorbent pad is placed on the finger or toe with the absorbent pad in direct contact with the nail bed.

In either scenario, the adjustable proximal end of the semi-rigid body is placed closer to the base of the finger or toe. The distal end of the semi-rigid body is placed closer to the tip part of the finger or toe. Once the semi-rigid body is positioned on the digit, the adjustable proximal end may be adjusted to the diameter of the finger or toe. Further, the stabilizing ring member of the semi-rigid body may be adjusted to the diameter of the finger or toe. The stabilizing ring member provides further steadiness to the device.

The absorbent pad is placed inside the semi-rigid body. Then, the semi-rigid body and absorbent pad are placed in the internal cavity of the flexible cover with the flexible cover surrounding the semi-rigid body. The flexible cover with the semi-rigid body and absorbent pad, as a whole, may then be placed on the finger or toe from which nail-enhancement product wants to be removed. The flexible cover molds to the shape of the finger or toe and of the semi-rigid body. Alternatively, the semi-rigid body and absorbent pad may be placed on the finger or toe first, and then, the flexible cover may be placed surrounding the semi-rigid body with the absorbent pad and the finger or toe.

Alternatively, the absorbent pad is placed on the finger or toe from which nail-enhancement product needs to be removed. Then, the semi-rigid body is placed on top of the absorbent pad. Once the semi-rigid body and absorbent pad are placed on top of the fingernail or toenail, then flexible cover is placed surrounding the finger or toe with the semi-rigid body and absorbent pad.

In any of the above scenarios, the aperture 56 of the semi-rigid body is placed on top of the absorbent pad allowing access to the absorbent pad from the external portion of the semi-rigid body. The absorbent pad is positioned between the distal end and the retaining member of the semi-rigid body. Further, the opening and lid of the flexible cover are aligned with the aperture of the semi-rigid body providing direct access to the absorbent pad through said aperture.

As illustrated in FIG. 22, the lid of the flexible cover is removably attached to the flexible cover with self-adhesive means 94. The lid may be completely detachable from the flexible cover from both sides. Alternatively, the lid may be semi-detachable from the flexible cover from only one side. In either case, the lid may further comprise a fold 90. The fold extends from one side of the lid to the opposite side. The fold allows the lid to remain in an open or semi-open position providing easier access to the absorbent pad.

As shown in FIGS. 24-25, the lid 84 of the flexible cover is opened providing access to the absorbent pad that has been placed on top of the fingernail or toenail. The lid of flexible cover is opened and removing solution 96, such as acetone, is added to the absorbent pad to remove nail-enhancement product from said fingernail or toenail. The absorbent pad may be a cotton pad or a foam pad, for example.

As discussed above, the lid is removably attached to the flexible cover. Once the removing solution has been added to the absorbent pad, the lid of the flexible cover is closed. Keeping the lid closed while the nail-enhancement product is loosened keeps any hazardous fumes of the removing solution from reaching the user or anyone in their surroundings. Furthermore, having a closed lid provides for the safe removal of the loosened nail-enhancement product and associated residues from the finger or toe.

Referring to FIG. 25, the closed-end portion of the flexible cover may include reservoir tip 86. After adding removing solution % to the absorbent pad, the user may slightly tilt the finger or toe causing any excess removing solution 96 to be collected in the reservoir tip 86. The reservoir tip prevents excess removing solution from reaching other parts of the finger or toe, in turn, reducing direct exposure to the hazardous solution.

After adding the removing solution to the absorbent pad, the device with the wetted absorbent pad is left stationary on top of the nail bed. Alternatively, or additionally, after a period of time, additional removing solution can be added to the absorbent pad, as necessary. As explained above, the lid of the flexible cover is removably attached to the flexible cover. The lid may be opened and closed, as necessary. A user may open the lid of the flexible cover to add more removing solution directly to the absorbent pad without having to remove the device from the finger or toe. Adding removing solution directly to the absorbent pad reduces direct exposure to the potentially hazardous removing solution and fumes.

The device with the wetted absorbent pad is kept on top of the fingernail or toenail until the nail-enhancement product has been loosened. Then, the device as a whole, i.e. flexible cover, semi-rigid body and absorbent pad, is removed from the finger or toe. Alternatively, the open-end portion of the flexible cover may be rolled up or be left in extended position, the flexible cover may be removed, and then the semi-rigid body and absorbent pad may be removed from the finger or toe. In either scenario, nail-enhancement product and associated residues adhere to the absorbent pad and remain contained inside the device. The device as a whole, i.e. flexible cover, semi-rigid body and absorbent pad, may be discarded. Alternatively, the absorbent pad can be separated from the semi-rigid body and replaced with a new absorbent pad; thus, leaving the device for further use.

While this invention has been shown and described with respect to a detailed embodiment thereof, it will be understood by those skilled in the art that changes in form and detail thereof may be made without departing from the scope of the claims of the invention.

What is claimed:

1. A device for removal of nail enhancement product from nail beds comprising:

a semi-rigid body;

an absorbent pad; and a flexible cover, wherein the semi-rigid body comprises an adjustable proximal end, a distal end, an external portion, an internal portion, and an aperture passing from the external portion to the internal portion, the internal portion including a retaining member, wherein the absorbent pad is positioned in the internal portion of the semi-rigid body between the retaining member and the distal end and is adapted to receive a removing solution, wherein the flexible cover comprises an internal cavity axially passing there through, a closed-end portion, an open-end portion, an opening, and a lid adapted to close the opening in order to encapsulate fumes of the removing solution inside the flexible cover, the flexible cover adapted to surround the semi-rigid body, wherein the aperture of the semi-rigid body and the opening of the flexible cover are axially aligned to allow access to the absorbent pad from outside of the device through the aperture of the semi-rigid body and the opening of the flexible cover, and wherein the aperture of the semi-rigid body and the opening of the flexible cover are configured to be disposed proximate a nail bed of a user while the device is placed on a digit of the user.

2. The device for removing nail enhancement product from nail beds as claimed in claim 1 wherein the retaining member comprises a top part, bottom part and a pair of sidewalls, the bottom part connected to the internal portion of the semi-rigid body leaving a space between the retaining member and the internal portion.

3. The device for removing nail enhancement product from nail beds as claimed in claim 1 wherein the absorbent pad is a cotton pad.

4. The device for removing nail enhancement product from nail beds as claimed in claim 1 wherein the absorbent pad is a foam pad.

5. The device for removing nail enhancement product from nail beds as claimed in claim 4 wherein the foam pad comprises centrally located perforations.

6. The device for removing nail enhancement product from nail beds as claimed in claim 1 wherein the adjustable proximal end of the semi-rigid body comprises a stabilizing ring member.

7. The device for removing nail enhancement product from nail beds as claimed in claim 1 wherein the distal end of the semi-rigid body is semi-oval shaped.

8. The device for removing nail enhancement product from nail beds as claimed in claim 1 wherein the closed-end portion of the flexible cover comprises a reservoir tip.

9. The device for removing nail enhancement product from nail beds as claimed in claim 1 wherein the lid of the flexible cover is detachable.

10. The device for removing nail enhancement product from nail beds as claimed in claim 1 wherein the lid of the flexible cover is semi-detachable.

11. A method for removing nail-enhancement product from nail beds comprising the steps:

a) placing a device on a digit, said device comprising:
a semi-rigid body;
an absorbent pad; and
a flexible cover,
wherein the semi-rigid body comprises an adjustable proximal end, a distal end,
an external
portion, an internal portion, and an aperture passing from the external portion to the internal portion,
the internal portion including a retaining member,
wherein the absorbent pad is positioned in the internal portion of the semi-rigid body between the retaining member and the distal end, and
wherein the flexible cover comprises an internal cavity axially passing there through, a closed-end portion, an open-end portion, an opening, and a lid, the flexible cover adapted to surround the semi-rigid body;

b) placing the semi-rigid body with the absorbent pad on the digit with the absorbent pad in direct contact with the nail bed, wherein the aperture of the semi-rigid body is proximate the nail bed of a user while the device is placed on the digit of the user;

c) surrounding the semi-rigid body with the flexible cover, wherein the opening of the flexible cover is proximate the nail bed of a user while the device is placed on the digit of the user, and wherein the opening of the flexible cover is axially aligned with the aperture of the semi-rigid body and absorbent pad to allow access to the absorbent pad from outside of the device through the aperture of the semi-rigid body and the opening of the flexible cover;

d) opening the lid of the flexible cover;

e) adding removing solution to the absorbent pad through the opening of the flexible cover and the aperture of the semi-rigid body wetting the absorbent pad;

f) closing the lid of the flexible cover;

g) leaving the device with the wetted absorbent pad on top of the nail bed until nail-enhancement product is loosened; and h) removing the device from the digit.

12. The method for removing nail-enhancement product from nail beds as claimed in claim 11 further comprising the step of adjusting the adjustable proximal end of the semi-rigid body to a diameter of the digit.

13. The method for removing nail-enhancement product from nail beds as claimed in claim 11 wherein the adjustable proximal end of the semi-rigid body comprises a stabilizing ring member.

14. The method for removing nail-enhancement product from nail beds as claimed in claim 13 further comprising the step of adjusting the stabilizing ring member of the adjustable proximal end of the semi-rigid body to a diameter of the digit.

15. The method for removing nail-enhancement product from nail beds as claimed in claim 11 wherein the closed-end portion of the flexible cover comprises a reservoir tip.

16. The method for removing nail-enhancement product from nail beds as claimed in claim 15 wherein after adding the removing solution to the absorbent pad, comprising the step:

tilting the digit slightly forward capturing any excess removing solution in the reservoir tip of the closed-end portion of the flexible cover.

17. The method for removing nail-enhancement product from nail beds as claimed in claim 11 wherein before removing the device from the digit, comprising the steps:

opening the lid of the flexible cover;
adding additional removing solution to the absorbent pad;
closing the lid of the flexible cover; and
leaving the device with the wetted absorbent pad on top of the nail bed until nail-enhancement product is loosened.

18. The method for removing nail-enhancement product from nail beds as claimed in claim 11 wherein the absorbent pad comprises a foam pad.

19. The method for removing nail-enhancement product from nail beds as claimed in claim 18 wherein the foam pad comprises centrally located perforations.

20. A device for removal of nail enhancement product from nail beds comprising:

a semi-rigid body;
an absorbent pad; and
a flexible cover,
wherein the semi-rigid body comprises an adjustable proximal end, a distal end, an external portion, an internal portion, and an aperture passing from the external portion to the internal portion,
the internal portion including a retaining member,
wherein the absorbent pad is positioned in the internal portion of the semi-rigid body between the retaining member and the distal end and is adapted to receive a removing solution,
wherein the flexible cover comprises an internal cavity axially passing there through, a closed-end portion, an open-end portion, an opening, and a lid adapted to close the opening in order to encapsulate fumes of the removing solution inside the flexible cover,
the flexible cover adapted to surround the semi-rigid body,
the closed-end portion of the flexible cover comprising a reservoir tip, the reservoir tip adapted to collect excess removing solution,
wherein the aperture of the semi-rigid body and the opening of the flexible cover are axially aligned to allow access to the absorbent pad from outside of the device through the aperture of the semi-rigid body and the opening of the flexible cover, and wherein the aperture of the semi-rigid body and the opening of the flexible cover are configured to be proximate a nail bed of a user while the device is placed on a digit of the user.

* * * * *